US006880198B1

(12) United States Patent
Hazard

(10) Patent No.: US 6,880,198 B1
(45) Date of Patent: Apr. 19, 2005

(54) ADJOINING SURFACE DEVICE FOR WORKING VISCOUS MATERIALS

(76) Inventor: David F. Hazard, 5201 Rigoletto St., Apt. 6, Woodland Hills, CA (US) 91364

( * ) Notice: Subject to any disclaimer, the term of this patent is extended or adjusted under 35 U.S.C. 154(b) by 0 days.

(21) Appl. No.: 08/585,968

(22) Filed: Nov. 24, 1995

Related U.S. Application Data

(63) Continuation-in-part of application No. 08/214,026, filed on Mar. 14, 1994, now abandoned, which is a continuation of application No. 07/880,571, filed on May 8, 1992, now abandoned.

(51) Int. Cl.[7] ..... B05C 17/10

(52) U.S. Cl. ..... 15/235.7; 15/235.4; 15/245.1; 425/458; D8/45

(58) Field of Search ..... 15/105.5, 235.3, 15/235.4–235.8, 236.01, 236.06, 236.09, 245, 245.1; 425/458; D8/45

(56) References Cited

U.S. PATENT DOCUMENTS

| | | | | | |
|---|---|---|---|---|---|
| 1,750,845 | A | * | 3/1930 | Lach | 15/245 |
| 1,999,367 | A | | 4/1935 | McCorkle | |
| 2,065,886 | A | | 12/1936 | Clift | 15/245 |
| 2,190,811 | A | * | 2/1940 | Zeeland | 15/235.4 |
| 2,551,105 | A | * | 5/1951 | Eiden et al. | 15/235.4 |
| 2,728,099 | A | * | 12/1955 | Cocco | 15/245 |
| 3,010,133 | A | * | 11/1961 | Hurd | 15/235.4 |
| 3,341,878 | A | * | 9/1967 | Hubbard | 425/458 |
| 3,686,703 | A | * | 8/1972 | Ray | 15/245 |
| 3,744,079 | A | | 7/1973 | Krause | 15/235.7 |
| 3,761,992 | A | | 10/1973 | Schneller | 15/210 R |
| 3,846,060 | A | | 11/1974 | Otis | 425/458 |
| 3,878,581 | A | * | 4/1975 | Perna | 15/235.3 |
| 4,211,501 | A | | 7/1980 | Perdroso et al. | |
| 4,217,673 | A | | 8/1980 | Pearson | 15/235.7 |
| 4,253,214 | A | * | 3/1981 | Bushee | 15/235.4 |
| 4,619,013 | A | | 10/1986 | Yon | 15/235.8 |
| 4,631,019 | A | | 12/1986 | House | 425/458 |
| 4,654,919 | A | * | 4/1987 | Liberman | 15/245.1 |
| 4,669,970 | A | | 6/1987 | Perry | 425/458 |
| 4,784,598 | A | | 11/1988 | Kranz et al. | 425/458 |
| 4,946,360 | A | * | 8/1990 | Brown | 15/245.1 |

FOREIGN PATENT DOCUMENTS

| | | | | |
|---|---|---|---|---|
| GB | 2219620 | * | 12/1989 | 15/235.4 |

* cited by examiner

*Primary Examiner*—Mark Spisich

(57) ABSTRACT

A device is provided for applying and/or finishing viscous materials along at least one adjoining surface or a bead along a corner, while simultaneously effecting all of the surfaces substantially free of any excess of the viscous material. The device includes a reinforcing portion (24), at least one operative extension (34R), (34L) with a working edge (56R), (56L) that protrudes beyond the termination (out of view) of the reinforcing portion, and a forward working edge (36), (38). The viscous material is formed with the forward edge. The angle of the operative extension edge to the forward edge is variable and resilient, which conforms to irregularities of the corner and variations in the position of the reinforcing portion and the forward working edge in relation to the adjoining surface, while sidewardly force is maintained against the adjoining surface. A seal is produced and maintained between the extension edge and the adjoining surface. The seal continuously prevents the viscous material from oozing between the extension edge and the adjoining surface, whereby a uniform clearly defined junction of the smooth applied surface and the clean unscathed adjoining surface is easily and efficiently produced.

7 Claims, 5 Drawing Sheets

134
142L
154L
150L
156
144
136
152R
138
142R
140
146
154R
148
150R 158
172L
170L
174L
168
166R
160
170R
162
172R
164

176
182L
186L
184
186R
178
182R
180

384B
382
384A
390
392A
392B
194
196L
196R
200L
200R
198L
198R
192
190
202
388
386

184
176
186R
178
182R
188
180

ADJOINING SURFACE DEVICE FOR WORKING VISCOUS MATERIALS

This application is a continuation-in-part of application Ser. No. 08/214,026, filed 14 Mar. 1994, now abandoned, which is a continuation of application Ser. No. 07/880,571, filed 8 May 1992, now abandoned.

BACKGROUND

1. Field of Invention

This invention relates to the building and construction arts, specifically to devices which are particularly effective in applying and finishing viscous materials along at least one adjoining surface, which are easy to use and efficient in producing a uniform, clearly defined continuous junction of the applied surface and the adjoining surface, while simultaneously all of the surfaces are effected substantially free of any excess of the material being applied.

2. Description of Prior Art

Heretofore, tools or other devices and methods for applying and finishing drywall joint compounds, spackle, plaster, cement, concrete, caulking, thinset, tile grout, other grouts, adhesives, resins, mastics, or other viscous materials, along at least one adjoining surface, have not been easy to use or efficient in effectively producing a uniform, clearly defined junction of the applied surface and the adjoining surface (here after to be referred to as adjoining surface), while simultaneously all of the surfaces are effected substantially free of any excess viscous material. Some of the commonly used tools for this process are a drywall taping knife or finishing knife, a float or finishing trowel for cement, a float or finishing trowel for plaster, a putty knife, etc., which have a semirigid, flat blade with rigid side edges at about 90 degrees to a straight forward working edge. For Example, during original construction and repair work, interior and exterior corners are frequently encountered where the surface to be worked upon more or less butts up against an adjoining surface. Some of the frequently encountered corners are where one wall adjoins either the ceiling, floor or another wall; where a wall meets a door casing, window frame, crown and base moulding, coving or wainscoating; where a window sill and/or jam meets a window frame; where a concrete slab meets a wall, or any other instance where a corner exists.

A two step operation for each application of material has been necessitated, by the fact that in the first step, the prior art devices currently in use fail to compensate for corner surface irregularities, thereby, depositing excess material upon the adjoining surface. This results in additional time and labor being spent to remove the excess material in the second step of the operation. In addition the second step exacerbates the possibility of physical disorders and injuries resulting from prolonged repetitive motions, e.g. carpal tunnel syndrome, grip loss, joint irritation and inflammation, etc.

The manner of using some of the commonly used prior art tools, to apply and smooth out viscous materials along an adjoining surface, is as follows: in the first step of the operation, while drawing one of the currently used tools along an inside corner, the tool is positioned with the working face of the tool blade basically at an acute angle to the work surface to be coated (here after to be referred to as work surface); the viscous material is sandwiched between the working face of the tool blade and the work surface; the forward working edge is more or less against or skimming over the work surface to which the material is being applied and is more or less at a right angle to the adjoining surface; one of the side edges of the tool is continuously pressed against and guided by the adjoining surface. The rigid side edges of the prior art tools do not compensate for irregularities of the adjoining guide surface and any inconsistencies of the angle of the corner being worked upon. In addition, they do not accommodate corners which deviate significantly from being more or less at right angles. The rigidity of the currently used tools results in the viscous material oozing between the side edge of the tool blade onto the adjoining surface. Furthermore, it is not feasible for a craftsman to continuously hold the prior art tools in a position to clean the adjoining surface of material being applied, while simultaneously applying and finishing the material along the same adjoining surface.

In the first step of the operation of applying and finishing, one of the forward corners of the tool blade is commonly pressed against the adjoining surface in order to extend the plane of the applied surface to the adjoining surface and clearly define the corner of the two surfaces. Thus, to insure continuous contact of the forward corner of the tool blade and the adjoining surface, the blade side edge is slightly pivoted away from the adjoining surface. The slight acute angle of the tool side edge and the adjoining surface allows the material being applied to flow between the tool side edge and the adjoining surface. This results in excess material being deposited onto both surfaces, mainly the adjoining surface. This excess material then must be removed in the second step of the operation.

The area of contact, between the forward corner of the tool blade and the adjoining surface which serves as a guide, is very small and does not span most irregularities of the adjoining guide surface. The blade, being rigid, transfers the shock, from the side edge traveling along the adjoining guide surface, to the forward working edge. The blade is very sensitive to the shape and texture of the adjoining guide surface. As the tool is pulled along the work surface and one of the forward corners of the blade rides along the adjoining surface, it follows the shape and texture of the adjoining surface. If the adjoining guide surface is not smooth, the rapid movement of the blade following the adjoining surface causes the blade to chatter, effecting irregularities in the applied surface, commonly referred to as chatter marks. In addition, the small point of contact between the forward corner of the tool blade and the adjoining guide surface tends to scrape a groove in the adjoining surface, with particles of material being scraped off and contaminating the material being applied. Therefore, the prior art tools require great skill to produce a smooth applied surface.

In the second step of this operation, employing the same tools as above or other devices, the undesirable excess material, which has oozed between the tool side edge and the adjoining surface, must be carefully scraped from the surfaces to eliminate protrusions from both surfaces. This is usually done after the material is fully dry or set. This procedure requires extreme care to avoid damaging the surfaces with the tool blade. For example, the adjoining surface can be scratched with the tool blade; cavities can occur where protrusions have been scraped away from the surfaces; the tool blade can cut into the applied surface while scraping excess material from the adjoining surface; the dried material, which had been urged into the void between the two adjoining surfaces, can be knocked out or cracked, etc.

Multiple applications of material are usually required to effect the desired results. For example, in residential and commercial construction sheets of gypsum wallboard, commonly known as drywall, that are usually 4 feet by 8 feet and from 0.5 inch to 0.75 inch in thickness, are fastened to vertical studs and horizontal joists by nails or screws. Due to irregularities in the framing, the adjoining surface, and/or the employed drywall edge there is usually a gap between the new wallboard surface and the adjoining surface. The gap is usually bridged with a reinforcing material, e.g. paper or fiberglass joint tape. The edge of the tape butts up to and conforms to the adjoining surface, thereby, extending the plane of the new drywall surface to the adjoining surface. The tape provides a bridging strength to the joint compound and conceals the gap at the corner. The craftsman first applies a bed coat of joint compound, in a relatively stiff aqueous slurry form, then lays the joint tape in the bed coat while it is still wet. Then, while drawing a taping knife or other device along the corner, as described above, the tape is pressed against the drywall work surface. This procedure squeezes out the excess compound and air pockets to ensure good penetration of the compound and adherance of the joint tape to the work surface. The craftsman removes the excess material after the compound is allowed to dry, usually for about one day. The craftsman then applies an additional coat of joint compound over the reinforcing tape. During the drying process the compound shrinks as the water evaporates from the compound, thereby, causing irregularities, such as concavities, in the applied surface. Therefore, three to four applications of joint compound are required to achieve a smooth surface. Furthermore, the damage to the surfaces incurred by the removal of the excess material, which has oozed between the side edge of the tool blade and the adjoining surface, necessitates the need for additional applications of material to fill in the voids.

In order to achieve the desired results, it is also common to apply one or more rough coats and finish coats of other viscous materials, e.g. spackle, plaster, and the like, due to voids, shrinkage, and/or to build up and shape the applied surface. Each additional application of material involves additional problems. If the adjoining surfaces are not scraped completely clean of excess material to provide smooth consistent guide surfaces for the tool blade to follow at the small rigid point of tool to surface contact, the tool will follow the uneven, irregular shape and texture of the surfaces, thereby, causing inconsistencies, e.g. chatter marks in the surface of the material applied. In order to fill in the valleys of the chatter marks, the craftsman must draw the tool in the opposite direction of the previous application. This is done by placing the forward working edge of the tool blade in and parallel to the inside corner, carefully tight against the adjoining surface, and then pulling it across the surface away from the inside corner. The attitude of the forward working edge of the tool blade is more or less at a right angle to the chatter marks, thereby, enabling the forward edge to span the indentations of the chatter marks. Otherwise, the tool would follow the shape and texture of the chatter marks in the previously applied surface. However, when running the tool blade in this direction the tool blade is not guided by firm guide surfaces, rather it skims along the soft material being applied. The craftsman attempts to apply a uniform surface in multiple and usually short overlapping passes. An attempt is made for each pass to effect a surface in the same plane of the previous pass, by floating the tool blade on the material being applied. This is a time consuming procedure that requires great skill to produce good, uniform results. Furthermore, the blade effects ridges in the applied surface, when the forward corners of the tool blade ride on the surface of the material being worked. These ridges, in the second step of the operation, are then scraped and/or sanded off of the surface when dry or set.

The scraping and sanding required in the second step of the operation produces particles of dried material and dust. In order to achieve good results, these particles and the dust must be removed from both surfaces before each additional application of material. The dust prevents the material from bonding to the work surface. If the particles of dried material, from the second step, are mixed in with the material being applied, the tool blade chatters as it rides on the chunks of dried material, thereby, effecting irregularities in the applied surface. Furthermore, the chunks of dried material stick to the forward working edge of the tool blade effecting grooves in the applied surface. Additional work time is required in the second step for the craftsman to fill in the chatter marks and/or grooves in the applied surface. The prior art tools, described above and other devices, are also used to clean the above described viscous materials and other materials out of bucket bottoms, drywall mud pans, etc. The same problems exist as a result of the tool blade being nonconforming, i.e. the material oozes between the side edge of the tool blade and the container, making it difficult to clean the container. Furthermore, the rigid edges of the tool blade tend to cut into and catch on the side walls of five gallon plastic buckets and other like surfaces. Plastic buckets are commonly used for mixing and holding drywall joint compound and the like. Therefore, cleanup of the aforementioned surfaces is a difficult and time consuming operation. These and other tool blades are usually made from some type of metal; for example, spring steel, which is flexible, but is susceptible to corrosion, such as rust.

In order to control the flexing and manipulate the blade of prior art tools, pressure is applied more or less continuously to various areas of the surface of the tool blade and to the handle. The desired flexing, in many situations, requires constant extension of the index finger and application of pressure by the finger, resulting in consistent, prolonged stress upon the joints in the hand and wrist area. In addition, repeated movement and rotation of the wrist joint is required, frequently resulting in carpal tunnel syndrome, grip loss, joint irritation and inflammation, and other work related physical disorders which result from prolonged repetitive motions. This has great significance as it has been estimated that prolonged repetitive motions are responsible for nearly 50% of disorders related to employment. The prior art tools require costly, tedious, and laborious reworking, for even the most proficient craftsman, to produce a high quality finished product.

Heretofore, tools or other devices and methods for forming a bead of caulking, sealants, or other viscous materials along a corner have not been easy to use or efficient in effectively producing uniform, clearly defined continuous junctions of the applied bead surface and the adjoining surfaces, while simultaneously effecting all of the surfaces substantially free of any excess of the material being applied. Some of the commonly used tools for this process are a wet sponge, one's finger, or a putty knife, which are cumbersome and relatively ineffective. For example, during original construction and/or repair work, interior and exterior inside corners are frequently encountered where there is an undesirable crack, seam, and/or irregularities at a corner. A bead of caulking is dispensed along the corner. The bead of caulking is then usually formed into a continuous uniform surface along the corner. The formed bead is intended to conceal the crack, seam, and/or irregularities of the corner. Often the formed bead is to remain unpainted or otherwise aesthetically blended with the adjoining surfaces. In most cases, the formed bead surface and the adjoining surfaces are desired to have clearly defined continuous corners, and to be free of excess viscous material. The various prior art devices used for this process do not produce the desired results easily and efficiently.

PRIOR ART PATENTS

I have not found any prior art patents directly germane to my invention, although inventors have created several types of devices with some similar features to that of my above patent. None of the devices apply and/or finish a viscous material along an adjoining surface or bead along a corner so as to efficiently and effectively produce uniform, clearly defined, continuous junctions of the applied surface and the adjoining surfaces, while simultaneously effecting all of the surfaces substantially free of any excess of the material being applied.

U.S. Pat. No. 2,065,886 to Clift (1936) discloses a kitchen utensil for cleaning of bowls, pots and pans etc., i.e. particularly rounded surfaces which do not present defined corners.

U.S. Pat. No. 3,744,079 to Krause (1973) discloses a tool that scrapes the excess caulk from an applied bead on an inside corner, but the working edges of the tool tend to catch on surfaces, and lack the ability to span adjacent tile grout joints or other deviations. Furthermore, when a third surface is encountered, the tool must be pushed up to the third surface, disrupting adjoining corner caulking beads.

U.S. Pat. No. 3,761,992 to Schneller (1973), U.S. Pat. No. 4,631,019 To House (1986) and U.S. Pat. No. 4,784,598 to Kraig, Kenneth and Kasey Kranz (1988) disclose tools for coating both surfaces and rounding of an inside corner, but lack the ability to produce defined corner surface junctions.

U.S. Pat. No. 3,846,060 to Otis (1974) discloses a troweling tool which has a blade which rides on both surfaces, displacing excess caulking outward onto both surfaces. The excess caulking must then be removed.

U.S. Pat. No. 3,878,581 to Perna (1975) discloses a tool with which it is difficult to apply a uniform coating of much thickness at a corner due to the sensitivity to positioning of the tool by the craftsman. Only one face of the blade can be used in order to prevent the rubber from peeling away from the rigid blade.

U.S. Pat. No. 4,211,501 To Pedroso (1980) discloses a tool for inside corners. The tool does not have a definite pivot point to accommodate variances in the position in which the tool is held in relation to the adjoining surfaces. Therefore, it is difficult to effectively position this tool in a corner to prevent material from oozing around the tool onto the surfaces.

U.S. Pat. No. 4,217,673 to Pearson (1980) discloses a tool for coating one side of an inside corner at a time, but does not effect a clean adjoining surface.

U.S. Pat. No. 4,654,919 to Liberman (1987) discloses a broad knife with resilient sheet material extending beyond the forward edge of a flat, rigid blade, but has rigid non-working side edges.

U.S. Pat. No. 4,669,970 to Perry (1988) discloses tools for finishing radius corners, which have a rubber sheet extending beyond the forward edge of a backing plate, but lack the ability to produce continuous defined corner junctions.

PRIOR ART SUMMARY

All of the tools, other devices, and methods heretofore known for applying and finishing viscous materials along at least one adjoining surface suffer from a number of disadvantages:

(a) The prior art devices and methods have not been easy to use, and efficient in effectively producing a uniform, clearly defined junction of the applied surface and the adjoining surface, while simultaneously effecting all of the surfaces substantially free of any excess of the material being applied.

(b) A two step operation for each application of material has been necessitated. This results in additional time and labor being spent to remove the excess material in the second step.

(c) The prior art tools require costly, tedious, and laborious reworking of the applied material, in both the first and second steps of the operation, for even the most proficient craftsman to produce a high quality finished product.

(d) The two step operation required for each application involves prolonged repetitive motion. This exacerbates the possibility of physical injuries/disorders which are caused by prolonged repetitive motion, e.g. carpal tunnel syndrome, grip loss, joint irritation and inflammation, etc.

(e) The commonly used tools for this process have a semirigid, flat blade, with rigid side edges at angles of about 90 degrees to a straight forward working edge, this being a nonvariable and nonflexible angle.

(f) The rigid angles and side edges of the prior art tools do not compensate for irregularities of the adjoining surface and any inconsistencies of the angle of the corner. They do not accommodate corners which deviate significantly from being more or less at right angles. The rigid angles and side edges result in the viscous material oozing between the side edge of the tool blade onto the adjoining surface and, in some situations, onto the applied surface.

(g) It is not feasible for a craftsman to continuously hold the prior art tools in position to clean the adjoining surface, while simultaneously applying and finishing material along the same adjoining surface.

(h) Usually the rigid blade side edge is slightly pivoted away from the adjoining surface at the forward corner of the tool blade, thereby, allowing the material being applied to flow between the tool side edge and the adjoining surface, resulting in excess material being deposited onto both surfaces.

(i) The undesirable excess material, which has oozed between the tool side edge and the adjoining surface, must be carefully scraped from the surfaces in the second step of the operation.

(j) Great skill is required to produce a smooth applied surface, as the area of contact between the forward corner of the tool blade and the adjoining surface is very small, i.e., the edge of the tool blade does not span most irregularities of the adjoining guide surface. Furthermore, the blade, being rigid, transfers the shock from the side edge traveling over the rough guide surface to the forward working edge, thus, if the adjoining guide surface is not smooth the rapid movement of the blade will effect irregularities. commonly known as chatter marks, in the applied surface.

(k) The small point of contact between the forward corner of the tool blade and the adjoining guide surface tends to scrape an undesirable groove in the adjoining surface.

(l) During the first step of the operation, the particles of material being scraped out of the guide surface at the small point of contact contaminate the material being applied.

(m) The scraping and cleaning procedure of the second step requires great care to avoid damaging the surfaces with the tool blade. For example:

The adjoining surface can be scratched with the tool blade.

Cavities can occur where protrusions have been scraped away from the surfaces.

The tool blade can cut into the applied surface while scraping excess material from the adjoining surface.

Dried material, which had been urged into the void between the two adjoining surfaces, can be knocked out or cracked.

(n) In each additional application of material, if the surfaces are not cleaned of excess material in the second step of the operation, and do not provide smooth straight guide surfaces for the tool to follow, at the small rigid point of tool to surface contact, will follow the shape and texture of the surfaces, effecting more chatter marks in the applied surface.

(o) In order to fill in the valleys of the chatter marks, the craftsman must make multiple passes in the opposite direction of t he previous coat, otherwise, the tool will follow the shape and texture of the chatter marks in the previous coat.

(p) When running the tool blade in the opposite direction of the previous coat, away from the corner of the two surfaces, the following problems are encountered:

The tool blade is not guided by firm guide surfaces. The blade floats along the soft material being applied, as the craftsman attempts to apply a uniform surface in multiple, and usually short, overlapping passes.

An attempt is made for each pass to effect a surface in the same plane as the previous pass, by floating the tool blade on the material being applied. This procedure requires great skill to produce good uniform results.

The blade effects ridges in the applied surface when the forward corners of the tool blade ride on the surface of the material being worked. In the second step of the operation, these ridges must be scraped and/or sanded off of the surface when dry, costing additional time and labor.

(q) The scraping and sanding process produces particles of dried material and dust which must be removed from both surfaces before each additional application of material. This must be done to prevent chunks of dried material from contaminating the material being applied, and to eliminate dust which prevents the material from bonding to the work surface. This second step of the operation is a time consuming process which is necessary to achieve good results.

(r) If the particles of dried material are mixed in with the material being applied, the tool blade chatters as it rides on the chunks of dried material, thereby, effecting chatter marks in the applied surface.

(s) The chunks of dried material also stick to the forward working edge of the tool blade resulting in grooves in the applied surface, thus requiring additional work time for the craftsman to fill in the grooves.

(t) As a result of the tool blade being nonconforming, the viscous material oozes between the side edge of the tool blade and the container used to hold the material, making it difficult to clean the container while working and during cleanup.

(u) The rigid edges of the tool blade tend to cut into and catch on surfaces, making application and cleanup a difficult and time consuming operation.

(v) These and other tool blades are usually made from some type of flexible metal; for example, spring steel, which is susceptible to corrosion, such as rust.

(w) None of the prior art devices, tools, and methods for applying and/or finishing a bead of viscous material along a corner are easy to use, and efficient in effectively producing uniform, clearly defined continuous junctions of the applied bead surface and the adjoining surfaces, while simultaneously effecting all of the surfaces substantially free of any excess of the material being applied.

OBJECTS AND ADVANTAGES

Accordingly, besides the objects and advantages of the adjoining surface device and methods described in my above patent, several objects and advantages of the present invention are:

(a) to provide a device for applying and finishing viscous materials along at least one adjoining surface which is easy to use, and efficient in effectively producing a uniform, clearly defined junction of the applied surface and the adjoining surface, while simultaneously all of the surfaces are effected substantially free of any excess of the material being applied;

(b) to provide a device that reduces a two step operation for each application of material to a one step operation, by effecting an adjoining surface substantially free of any excess viscuos material, while simultaneously applying and/or finishing viscous material along the same adjoining surface, thereby, eliminating the time and costly labor required to remove excess material;

(c) to provide a device which permits even the less skilled and less proficient craftsman to produce a high quality finished product without the tedious, laborious, time consuming, and costly reworking of the applied surface of material, in both the first and second steps of the operation, as required in the use of the prior art devices;

(d) to provide a device which reduces the risk of carpal tunnel syndrome and other physical disorders related to prolonged repetitive motion and pressure, by substantially reducing the work required to produce a high quality, continuous applied surface of viscous material along at least one adjoining surface;

(e) to provide a device which automatically conforms to irregularities, by having angles of the side edges to the forward edge that are variable, flexible, resilient, and versatile, which allows the device to conform to irregularities;

(f) to provide a device which prevents the viscous material from oozing between the side working edge of the device onto the adjoining surface to remain clean, by having at least one operative extension that compensates for irregularities of the adjoining surface and any inconsistencies of the angle of a corner which deviates significantly from being at right angles, i.e. a sealtight connection is produced between the working edge of the operative extension and the adjoining surface to be clean of material being applied;

(g) to provide a device that, while in use, is feasible for a craftsman to continuously hold in position to substantially clean the adjoining surface of viscous material being applied, while simultaneously applying and finishing the material along the same adjoining surface;

(h) to provide a device that eliminates the second step of a two step operation, by preventing the need to remove any excess material from either surface after each application of material, by the fact that when in use an operative extension is tightly urged against the adjoining surface, by producing a seal at this point of contact the device is allowed to pivot at the forward corner of the side edge and the forward edge, while maintaining the sealtight connection between the side edge and the adjoining surface, by having the seal prevent the material being applied from flowing between the side edge and the adjoining surface which is to be clean;

(i) to provide a device where considerably less skill is required to produce a smooth applied surface by greatly reducing, if not eliminating, the effecting of irregularities in the applied surface, commonly referred to as chatter marks, by continuously having a very large area of contact between an operative extension and the adjoining surface the device spans the irregularities in the adjoining guide surface, by having the operative extension absorb the shock of the side edge traveling along the adjoining guide surface a steady forward working edge is maintained for forming the desired shape and texture of the applied surface, and by the device being substantially less sensitive to the shape and texture of the adjoining guide surface than the prior art devices;

(j) to provide a device that does not scrape a groove in the adjoining surface, by having a large nonabrasive point of contact between the device and the adjoining guide surface;

(k) to provide a device that prevents particles from being scraped out of the guide surface and contaminating the material being applied, by having a large nonabrasive point of contact between the device and the adjoining guide surface;

(l) to provide a device that eliminates the deposit of any undesirable excess material, thereby, eliminating the need for a second step in the operation to carefully scrape the surfaces prior to each additional application of material;

(m) to provide a device that effects desirable results along at least one adjoining surface, by preventing an undesirable excess of material on the surfaces, thereby, eliminating the need for a second step in the operation to scrape the adjoining surfaces clean of protruding excess material, whereby, the adjoining surface will not be scratched, no protusions will exist, therefore no scraping is required, and no cavities are created, no grooves or cuts will be effected in the surfaces, no dried material, which had been urged into the void between the two surfaces, will be cracked or broken out, and the inside corner will be clean and uniform;

(n) to provide a device which greatly reduces, if not eliminates, chatter marks in the surface of the material being applied, by having a large flexible point of contact between the device and the adjoining surface, by having a large point of contact which, together with the resilient angle of the side and forward edges, enables the device to conform to the adjoining guide surface, and absorb the shock of the device traveling along the adjoining surface;

(o) to provide a device that greatly reduces, if not eliminates, chatter marks in the applied surface, and the need for the craftsman to run the device in the opposite direction of the previous coat, in order to fill in the valleys of the chatter marks, thereby, reducing the time and labor required to produce good results;

(p) to provide a device that, by eliminating the need to run the blade in the opposite direction of the hardened coat of material previously applied and away from the corner of the two surfaces, saves costly additional time and skilled labor being spent in a second step of the operation to sand, and/or scrape ridges off of the surface when dry, and furthermore, eliminating problems in the first step occurring with the prior art devices, those problems being the blade not being guided by firm adjoining guide surfaces i.e. the blade rides along the soft material being applied as the craftsman attempts to apply a uniform surface in multiple, and usually short, overlapping passes, the need for an attempt to be made for each pass to effect a surface in the same plane of the previous pass, by floating the blade on the material being applied, which requires great skill to produce good uniform results, and the blade effecting ridges in the applied surface when the forward corners of the blade ride on the surface of the material being applied and worked;

(q) to provide a device that achieves good, expedient results by greatly reducing, if not eliminating, the time consuming scraping and sanding process of the second step, thus eliminating not only the production of particles of dried material but dust, which prevents the material from bonding to the work surface and must be removed from both surfaces before each additional application of material;

(r) to provide a device that obviates the additional time a craftsman spends to fill in chatter marks in the applied surface, by significantly reducing and/or eliminating dry particles of excess material being mixed in with the material being applied, causing the device to chatter as the blade rides on the chunks of dried material;

(s) to provide a device that obviates the additional time a craftsman spends filling grooves cut into the applied surface, by significantly reducing or eliminating the chunks of dried material that stick to the forward working edge which effect the grooves;

(t) to provide a device that can be easily and efficiently used to clean a bucket, drywall mud pan or other containers, and has an operative extension which is conforming, thereby, preventing the viscous material from oozing between the side edge of the device and the container;

(u) to provide a device that makes application and cleanup an easy and efficient operation, by having side edges that do not cut into and catch on surfaces;

(v) to provide a device that is not susceptible to corrosion such as rust; and (w) to provide a device for applying and/or finishing a bead of viscous material along a corner that is easy to use, efficient, and effective in producing uniform, clearly defined continuous junctions of the applied bead surface and the adjoining surfaces, while simultaneously effecting all of the surfaces substantially free of any excess of the material being applied.

Further objects and advantages are to provide a device which can be used easily and conveniently to apply and/or finish viscous material along at least one adjoining surface, while simultaneously effecting all of the surfaces substantially free of any excess of the material being applied without damage to the surfaces;

which is simple to use and inexpensive to manufacture;

which has a reinforcing portion that enables the desired flexing of the forward edge when the craftsman applies pressure to the device against the viscous material being applied, while simultaneously forming a slightly concave surface of the material of a desired maximum thickness at an inside corner, extending outward in a slight curve to a thin outer edge, which is feathered to a thinness that is essentially zero, thus, the thin outer edge and the work surface are blended imperceptibly in the same plane, while the inner region is thick enough to cover surface tape at the corner or other undesirable protrusions and irregularities;

which has a reinforcing portion that flexes mainly in the forward region, when the device is pressed against the viscous material being applied and finished, thus, the craftsman can adjust the angle of the major face in the forward region and the work surface by regulating the amount of pressure applied to the device, thus enabling the craftsman to flex the reinforcing portion, and to achieve diminutive angles of the forward region of the reinforcing portion and the work surface, allowing the device to somewhat float on top of and spread out the viscous material, while the rear portion and the handle are at a considerable angle away from the work surface;

which has a flexible reinforcing portion and/or operative extensions that return to a flat shape, more or less in one plane when released, that facilitate wiping the blade clean of work material while in use and during the cleanup operation;

which has a laminar juxtaposed construction not prone to peeling or separation while in use or otherwise manipulated within reason;

which has two side operative extensions, identical to each other, for wiping clean the adjoining surface, so that when material is being applied with one face of the device the side edges can be used interchangeably, i.e. left side edge is used in one direction and the right side edge in the other direction, without the need to clean the viscous material from one face of the tool blade in order to use it in the opposite direction on the same surface, e.g., while applying material to the full length of one surface of an inside corner of two walls from floor to ceiling, the crafstman draws the tool from one end to about the center of the length of the corner, the craftsman then draws the tool from the other end to the center and partially over the soft surface of the material that was previously applied in the opposite direction, thereby, blending the two applied surfaces into the same plane, to produce a continuously smooth and defined corner.

Still further objects and advantages will become apparent from a consideration of the ensuing descriptions and drawings.

DRAWING FIGURES

In the drawings, closely related figures have the same number, but different alphabetical suffixes.

REFERENCE NUMERALS IN DRAWINGS

Figure 1A:
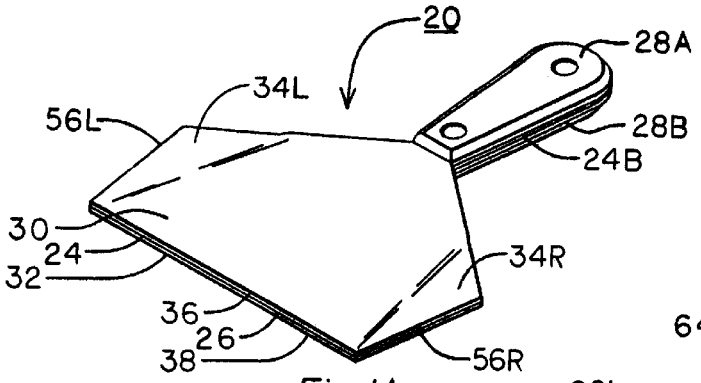
FIGS. 1A to 1F show various aspects of an adjoining surface device in the form of a hand tool, that resembles a drywall taping knife supplied with flexible operative side extensions affixed to the blade.

In the drawings, similar parts have the same reference number, but different alphabetical suffixes. The suffixes: R=Right, L=Left

Figure 1B:
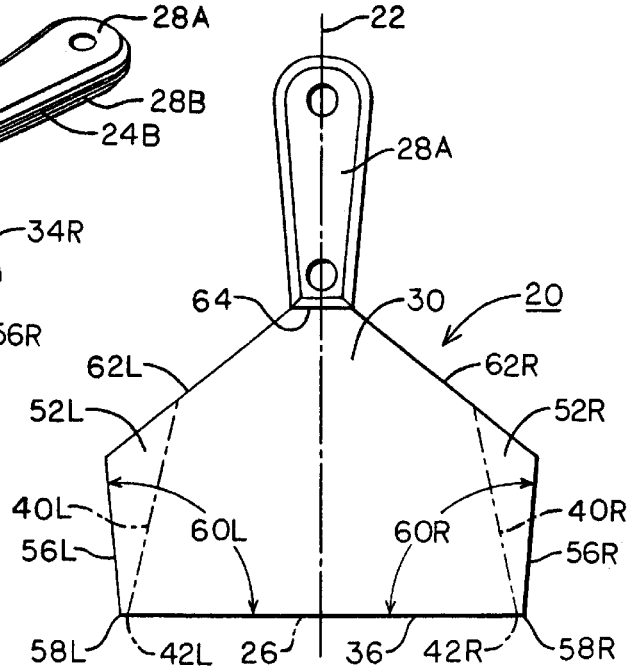
Figure 1C:
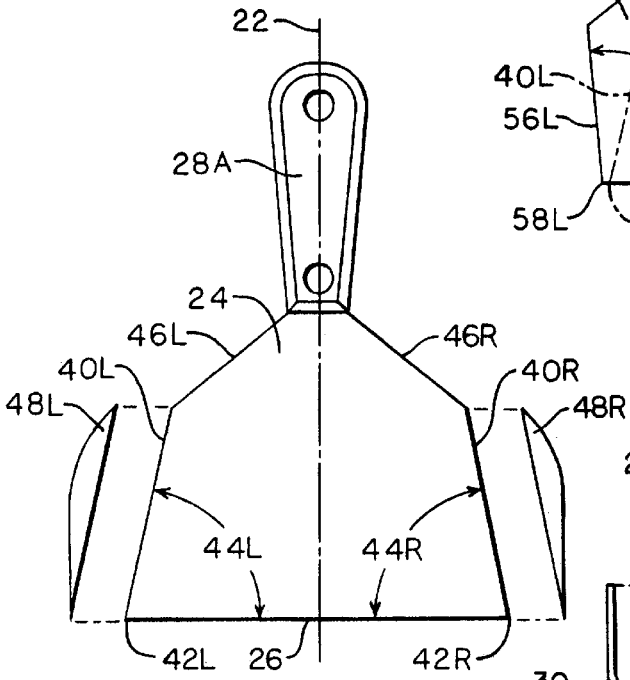
Figure 1F:
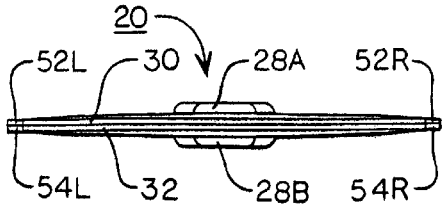
Figure 1D:
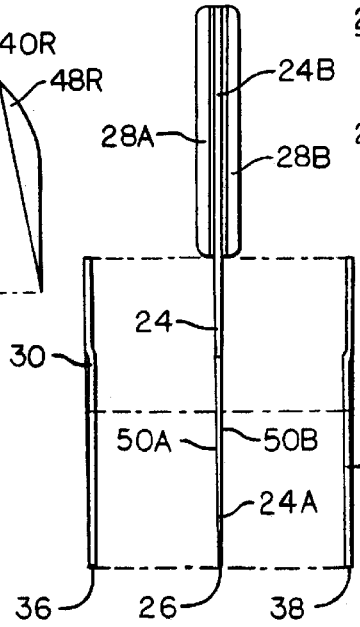
Figure 1E:
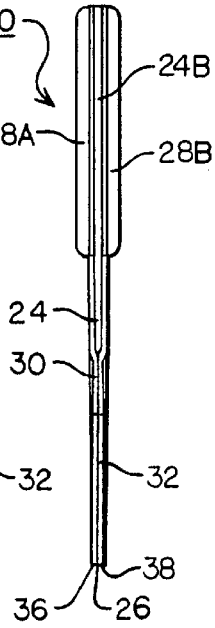
Figure 2A:
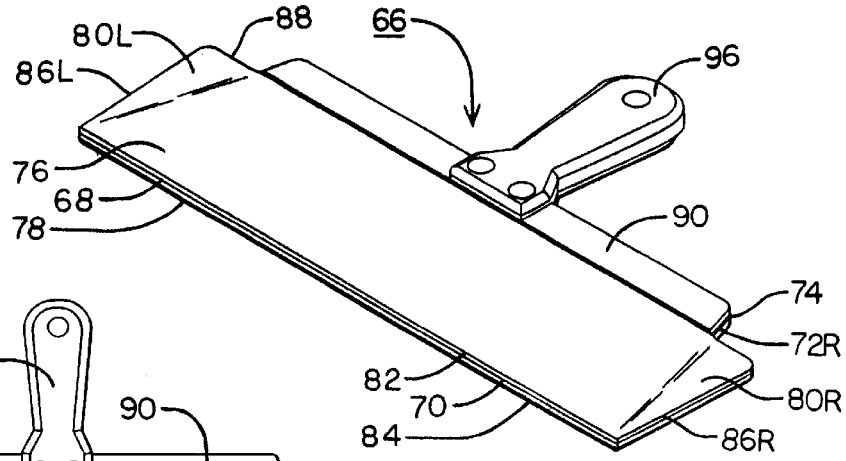
FIGS. 2A to 2C show a similar tool that resembles a drywall broad knife.
Figure 2B:
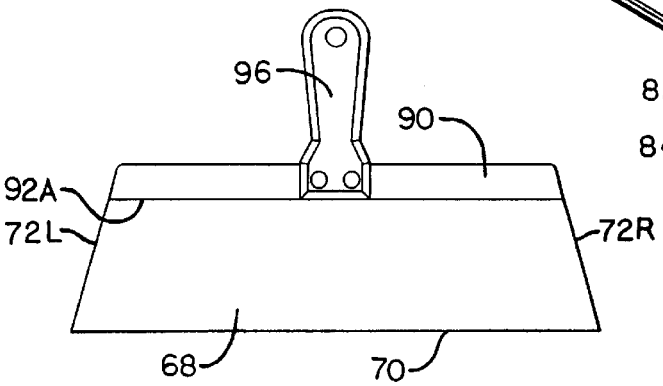
Figure 2C:
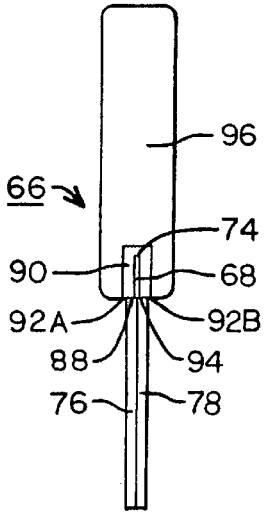

| FIGS. 1A to 1F | |
|---|---|
| 20 | tool 20 |
| 22 | center line |
| 24 | reinforcing portion |
| 24A | forward region of portion 24 |
| 24B | rearward extending segment of portion 24 |
| 26 | forward edge of portion 24 |
| 28A, 28B | handle halves |
| 30, 32 | flexible sheets |
| 34R, 34L | operative extensions |
| 36, 38 | forward edge of sheets 30, 32 |
| 40R, 40L | side edges of portion 24 |
| 42R, 42L | forward corners of portion 24 |
| 44R, 44L | angles of side edges to forward edge of portion 24 |
| 46R, 46L | aft side edges of portion 24 |
| 48R, 48L | side segments cut off of portion 24 |
| 50A, 50B | major faces of portion 24 |
| 52R, 52L | side extension portions of sheet 30 |
| 54R, 54L | side extension portions of sheet 32 |
| 56R, 56L | side edges of sheet 30 |
| 58R, 58L | forward corners of sheet 30 |
| 60R, 60L | angles of side edges to forward edges of sheet 30 |
| 62R, 62L | aft side edges of sheet 30 |
| 64 | rear edge of sheet 30 |
| FIGS. 2A to 2C | |
| 66 | tool 66 |
| 68 | reinforcing portion |
| 70 | forward edge of portion 68 |
| 72R, 72L | side edges of portion 68 |

-continued

Figure 3:
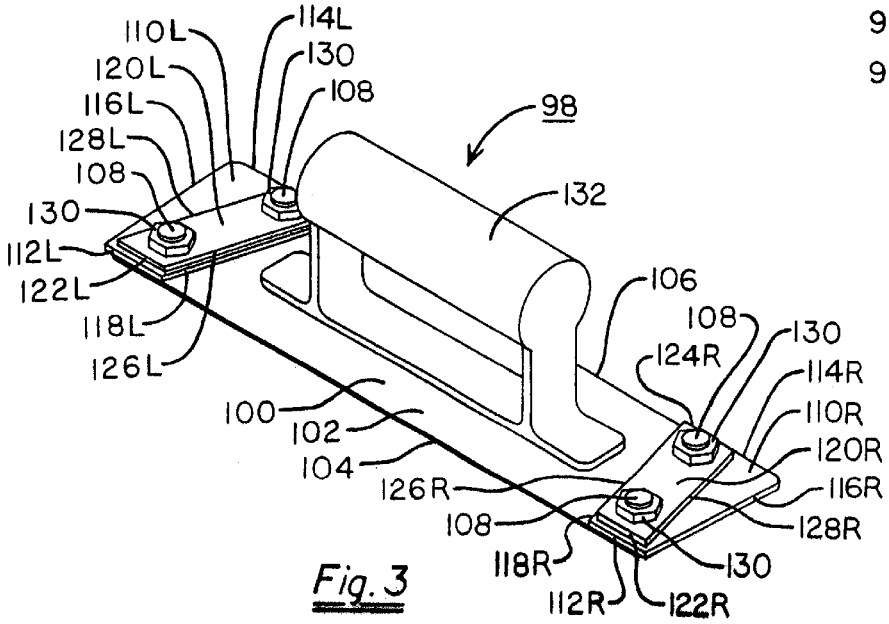
FIG. 3 shows a similar tool that resembles a cement or plaster trowel.
Figures 4, 5, 6A, 6B, 7:
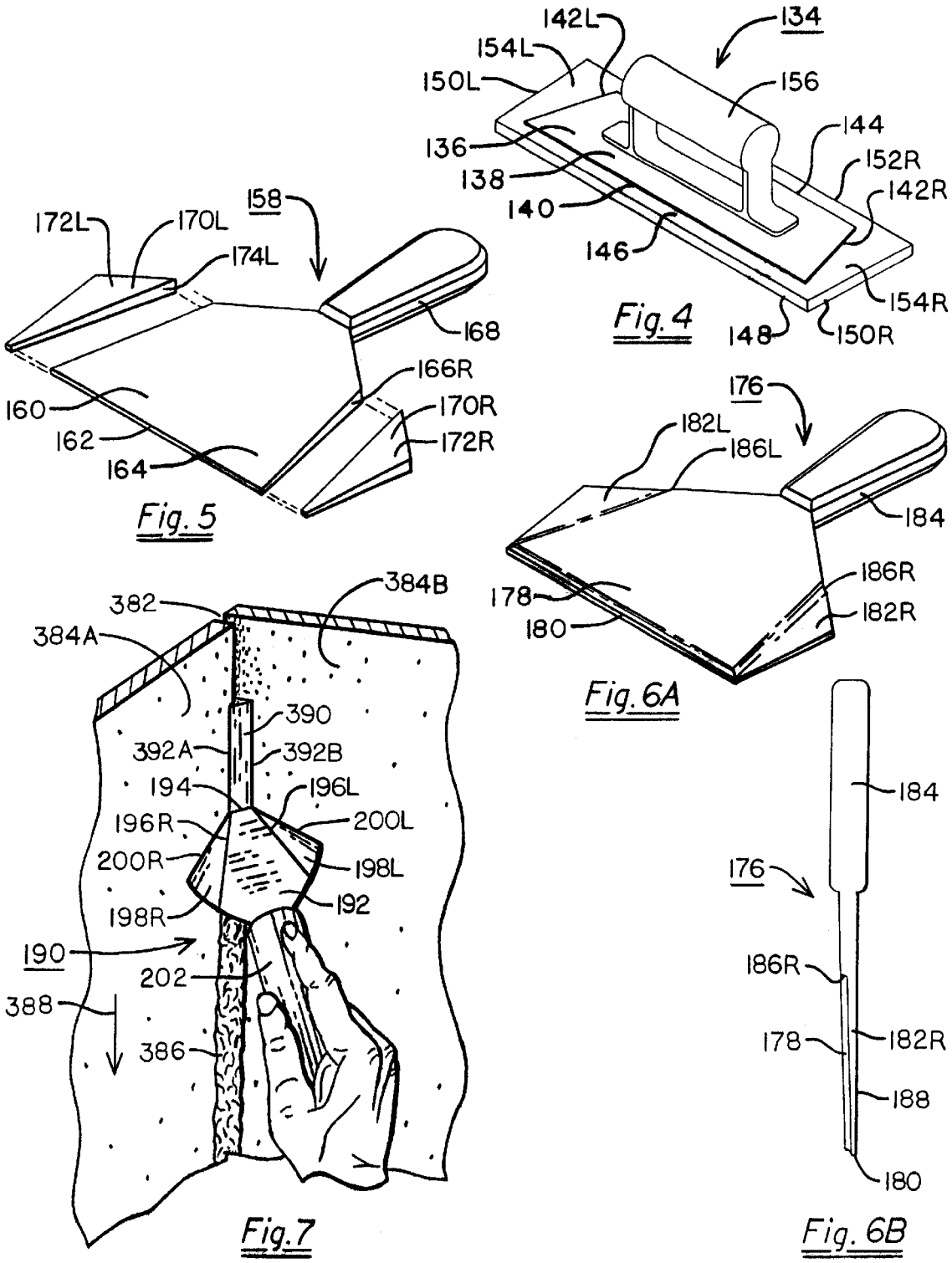
FIG. 4 shows a similar tool that resembles a plastering and grouting float.
FIG. 5 shows a tool similar to the tool shown in FIGS. 1A to 1F, with the operative extensions affixed to the side faces of the reinforcing portion.
FIGS. 6A and 6B show a similar tool formed of moldable material having a plurality of thicknesses for controlled flexing.
FIG. 7 shows a tool similar to the tools shown in FIGS. 1 to 6, configured for forming a bead of viscous material along a corner, and shows the manner of using the tool 190.
Figure 8:
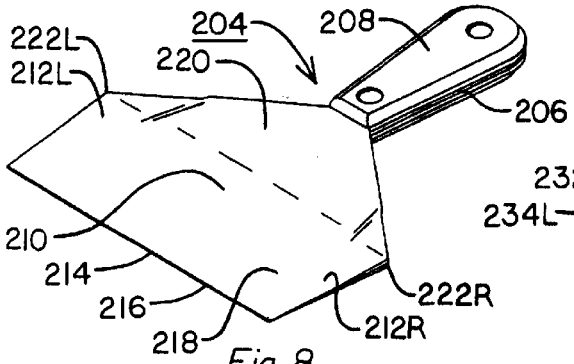
FIG. 8 shows a tool similar to the tool shown in FIGS. 1A to 1F, with operative extensions of tapered cross section.

| | |
|---|---|
| 74 | rear edge of portion 68 |
| 76, 78 | flexible sheets |
| 80R, 80L | operative extensions |
| 82, 84 | forward edge of sheets 76, 78 |
| 86R, 86L | side edges of sheet 76 |
| 88 | rear edge of sheet 76 |
| 90 | rear edge support |
| 92A, 92B | forward edges of support 90 |
| 94 | rear edge of sheet 78 |
| 96 | handle |
| FIG. 3 | |
| 98 | tool 98 |
| 100 | reinforcing portion |
| 102 | back face of portion 100 |
| 104 | forward edge of portion 100 |
| 106 | rear edge of portion 100 |
| 108 | stud type fasteners |
| 110R, 110L | operative extensions |
| 112R, 112L | forward edges of extensions 110R, 110L |
| 114R, 114L | rear edge of extensions 110R, 110L |
| 116R, 116L | outwardly facing edge of extensions 110R, 110L |
| 118R, 118L | inwardly facing edge of extensions 110R, 110L |
| 120R, 120L | clamp plates |
| 122R, 122L | forward edges of plates 120R, 120L |
| 124R, 124L | rear edges of plates 120R, 120L |
| 126R, 126L | inwardly. facing edges of plates 120R, 120L |
| 128R, 128L | outwardly facing edges of plates 120R, 120L |
| 130 | nut type fasteners |
| 132 | handle |
| FIG. 4 | |
| 134 | tool 134 |
| 136 | reinforcing portion |
| 138 | back face of portion 136 |
| 140 | forward edge of portion 136 |
| 142R, 142L | side edges of portion 136 |
| 144 | rear edge of portion 136 |
| 146 | flexible sheet |
| 148 | forward edge of sheet 146 |
| 150R, 150L | side edges of sheet 146 |
| 152 | rear edge of sheet 146 |
| 154R, 154L | operative extensions |
| 156 | handle |
| FIG. 5 | |
| 158 | tool 158 |
| 160 | reinforcing portion |
| 162 | forward edge |
| 164 | major face of portion 160 |
| 166R | side face of portion 160 |
| 168 | handle |
| 170R, 170L | operative extensions |
| 172R, 172L | major faces of extensions 170R, 170L |
| 174L | side face of extension 170L |
| FIGS. 6A, 6B | |
| 176 | tool 176 |
| 178 | reinforcing portion |
| 180 | forward edge |
| 182R, 182L | operative extension portions |
| 184 | handle portion |
| 186R, 186L | rear corners of extension portions 182R, 182L |
| 188 | major face |
| FIG. 7 | tool 190 |
| 190 | tool 190 |
| 192 | reinforcing portion |
| 194 | forward edge |
| 196R, 196L | side terminations of portion 192 |
| 198R, 198L | operative extensions |
| 200R, 200L | side edges of extensions 198R, 198L |
| 202 | handle |
| FIG. 8 | |
| 204 | tool 204 |
| 206 | reinforcing portion |
| 208 | handle |
| 210 | flexible sheet |
| 212R, 212L | operative extensions |

-continued

Figure 9:
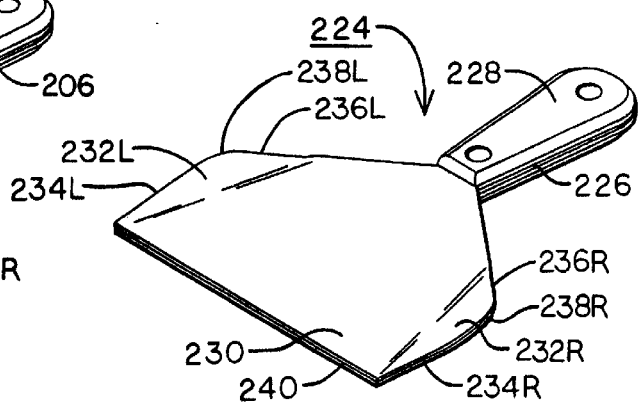
FIG. 9 shows a similar tool, with operative extensions having curved working edges.
Figure 10A:
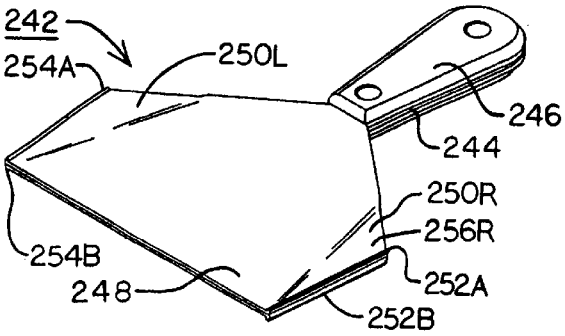
FIGS. 10A and 10B show a similar tool, with operative extensions having lipped working edges.
Figure 10B:
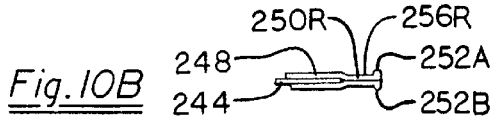
Figure 11:
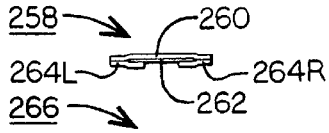
FIGS. 11 to 13 show various dispositions of at least one flexible sheet and at least one reinforcing portion.
Figure 12:
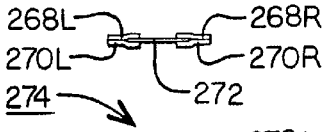
Figure 13:
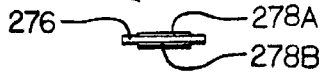
Figure 14:
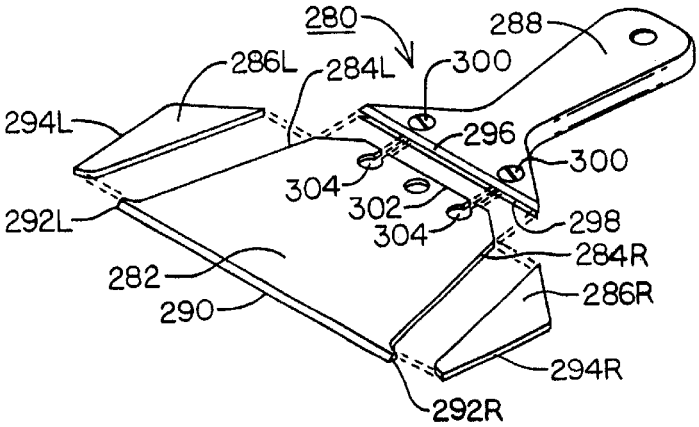
FIG. 14 shows a tool similar to the tool shown in FIG. 5, with indented side terminations of the reinforcing portion.
Figure 15:
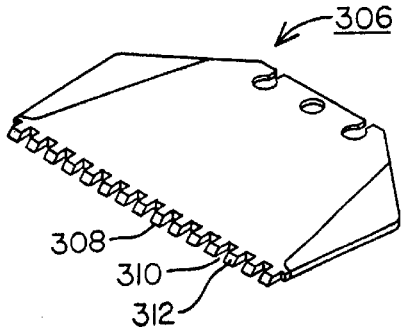
FIG. 15 shows a similar replacement operative extension and reinforcing portion assembly, with a forward edge having a plurality of notches.
Figure 16:
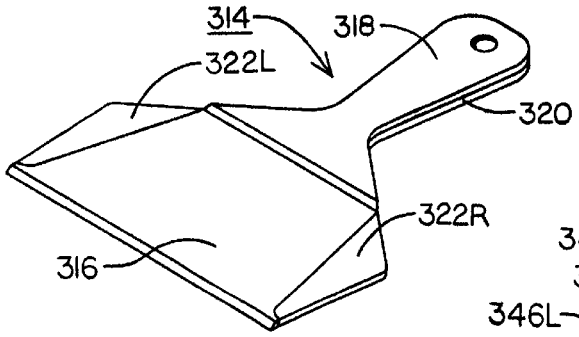
FIG. 16 shows a similar tool, with a reinforcing portion and handle formed as one unit.
Figure 17:
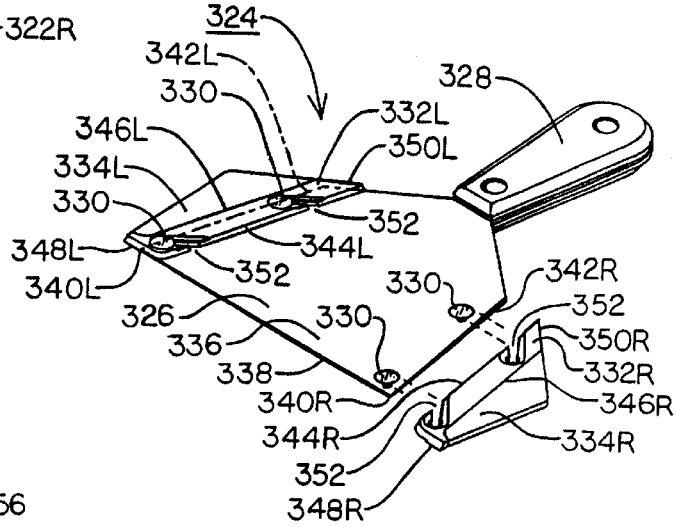
FIG. 17 shows a similar tool, with operative extensions affixed to replaceable support plates which are interconnected with a reinforcing portion is similar to the reinforcing portion of the tool shown in FIGS. 1C, and 1D.

| | |
|---|---|
| 214 | forward edge of portion 206 |
| 216 | forward edge of sheet 210 |
| 218 | tapered section of sheet 210 |
| 220 | nontapered section of sheet 210 |
| 222R, 222L | side corners of extensions 212R, 212L |
| FIG. 9 | |
| 224 | tool 224 |
| 226 | reinforcing portion |
| 228 | handle |
| 230 | flexible sheet |
| 232R, 232L | operative extensions |
| 234R, 234L | side edges of extensions 232R, 232L |
| 236R, 236L | aft side edges of extensions 232R, 232L |
| 238R, 238L | rounded side corners |
| 240 | forward edge |
| FIGS. 10A, 10B | |
| 242 | tool 242 |
| 244 | reinforcing portion |
| 246 | handle |
| 248 | flexible sheet |
| 250R, 250L | operative extensions |
| 252A, 252B | lipped side edges of extension 250R |
| 254A, 254B | lipped side edges of extension 250L |
| 256R, | major face of extension 250R, |
| FIG. 11 | |
| 258 | device 258 |
| 260 | flexible sheet |
| 262 | reinforcing portion |
| 264R, 264L | sheet segments |
| FIG. 12 | |
| 266 | device 266 |
| 268R, 268L | flexible sheet segments |
| 270R, 270L | flexible sheet segments |
| 272 | reinforcing portion |
| FIG. 13 | |
| 274 | device 274 |
| 276 | flexible sheet |
| 278A, 278B | reinforcing portions |
| FIG. 14 | |
| 280 | tool 280 |
| 282 | reinforcing portion |
| 284R, 284L | side terminations of portion 282 |
| 286R, 286L | operative extensions |
| 288 | handle |
| 290 | forward edge of portion 282 |
| 292R, 292L | forward corners of portion 282 |
| 294R, 294L | side edge of extensions 286R, 286L |
| 296 | forward edge of handle 288 |
| 298 | slot along edge 296 |
| 300 | fasteners in handle 288 |
| 302 | rear edge of portion 282 |
| 304 | slotted openings in edge 302 |
| FIG. 15 | |
| 306 | reinforcing portion and extension assembly 306 |
| 308 | forward edge of assembly 306 |
| 310 | notches in edge 308 |
| 312 | teeth defined by notches 310 |
| FIG. 16 | |
| 314 | tool 314 |
| 316 | reinforcing portion |
| 318 | handle portion |
| 320 | additional handle portion |
| 322R, 322L | operative extensions |
| FIG. 17 | |
| 324 | tool 324 |
| 326 | reinforcing portion |
| 328 | handle |
| 330 | fasteners |
| 332R, 332L | support plates |
| 334R, 334L | operative extensions |

-continued

Figure 18:
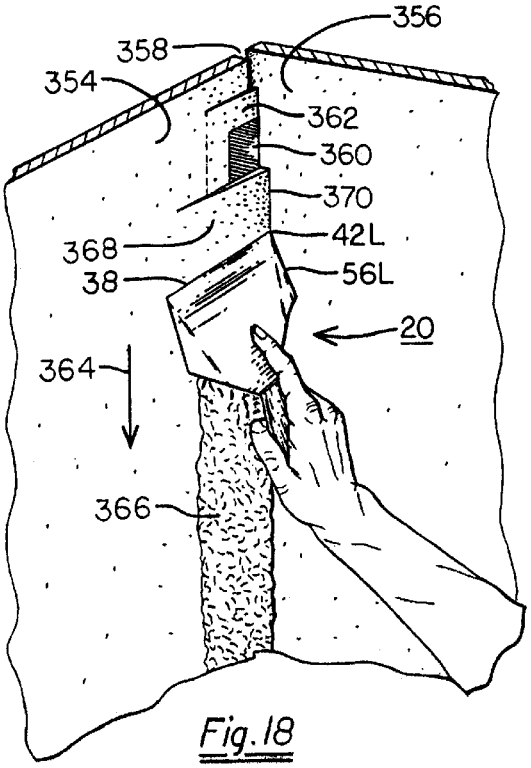
FIG. 18 shows the manner of using the tool 20.
Figure 19:
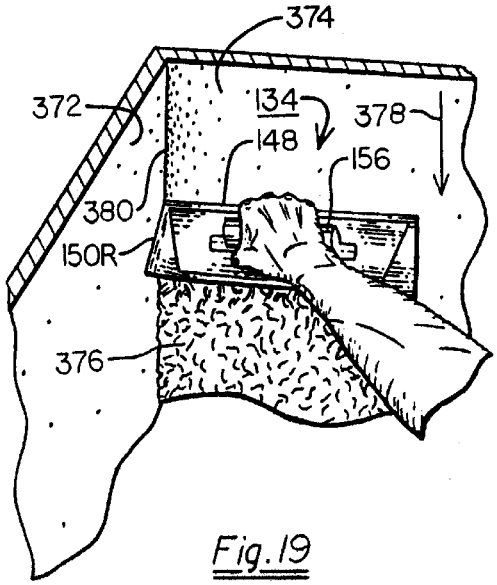
FIG. 19 shows the manner of using the tool 134.

| | |
|---|---|
| 336 | major face of portion 326 |
| 338 | forward edge of portion 326 |
| 340R, 340L | forward corners of portion 326 |
| 342R, 342L | side edges of portion 326 |
| 344R, 344L | inwardly facing side edges of plates 332R, 332L |
| 346R, 346L | side terminations of plates 332R, 332L |
| 348R, 348L | forward edges of plates 332R, 332L |
| 350R,350L | rear edges of plates 332R, 332L |
| 352 | slotted openings in plates 332R, 332L. |
| FIG. 18 | operation of tool 20 |
| 354 | work surface |
| 356 | adjoining surface |
| 358 | gap at corner of 354 and 356 |
| 360 | joint tape |
| 362 | bed coat of compound |
| 364 | direction of motion |
| 366 | compound for additional coat |
| 368 | applied surface of additional coat |
| 370 | junction of surfaces 356 and 368 |
| FIG. 19 | operation of tool 134 |
| 372 | adjoining surface |
| 374 | applied surface |
| 376 | material being applied |
| 378 | direction of motion |
| 380 | junction of surfaces 372 and 374 |
| | operation of tool |
| 382 | crack at corner |
| 384A 384B | two adjoining surfaces |
| 386 | dispensed bead of caulking |
| 388 | direction of motion |
| 390 | formed bead of caulking |
| 392A 392B | corners of bead 390 and surfaces 384A, 384B |

Description—FIGS. 1 to 17

For exemplary purposes, all of the embodiments of the adjoining surface device of the present invention, shown and first described, are in the form of a hand tool, and are configured for use on inside corner surfaces, which are more or less 90 degrees to each other, and in each case, the devices are generally symmetrical, perpendicular to a forward edge.

A typical embodiment of the adjoining surface device of the present invention is illustrated in FIG.1A (isometric view), FIG. 1B (top plan view), FIG. 1C (top plan view of reinforcing portion with handle), FIG. 1D (exploded side view), FIG. 1E (side view), and FIG. 1F (end view). It will be observed that a hand tool is generally indicated by numeral 20. Referring first to FIG. 1A, the tool 20 consists of three principal elements, which are generally symmetrical about a common fore and aft center line 22 (FIG. 1B, top plan view). A thin, flat, semirigid reinforcing blade portion 24 (best shown in FIG. 1C, top plan view of reinforcing portion with handle) for added structural integrity, consists of flexible sheet like material that, when repeatedly flexed and released, returns to the original shape without cracking. As shown in FIG. 1A, the reinforcing portion 24 has a straight forward working edge 26 and a rearwardly extending segment 24B. Affixed to the segment 24B of the reinforcing portion 24 is a handle with two handle halves 28A, 28B (the second principal element), that serves as a means of applying a controlled directional force to the device. The reinforcing portion 24 is laminated between two identical resilient flexible sheets 30, 32 (the third principal element). Furthermore, the sheets 30, 32 extend symmetrically sidewardly beyond the corresponding terminations of the reinforcing portion 24, and are laminated to each other to create two flexible resilient operative extension side wiper blades 34R, 34L. The two flexible sheets 30, 32 each have a straight forward working edge 36, 38. The forward edges 36, 38 of the sheets 30, 32 are more or less coterminus with the corresponding forward edge 26 of the reinforcing portion 24.

Referring now to FIG. 1C (top plan view of the reinforcing portion with handle), the reinforcing portion 24 has two straight side edges 40R, 40L which terminate at forward corners 42R, 42L, with the forward edge 26 forming acute angles 44R, 44L; two straight aft side edges 46R, 46L and the rearwardly extending segment 24B (which is out of view, but shown in FIG. 1D exploded side view). For example, a 6 inch wide steel drywall taping knife has the semirigid reinforcing blade portion 24 with the handle halves 28A, 28B (28B out of view) affixed. The reinforcing portion 24 has two side segments 48R, 48L, which have been cut off at the angles 44R, 44L of 50 to 85 degrees to the forward working edge 26, making the side edges 40R, 40L, which are 2 to 5 inches in length. There are many tools of a suitable size shape, and material readily available which can be modified in this manner, such as a 6 inch steelhead taping knife model No. 526 available from Warner® Tool Manufacturing Co. of Minneapolis, Minn. However, the reinforcing portion 24 can consist of any other material which has sufficient structural integrity for a forward working edge, and to support the operative side extensions 34R, 34L (shown in FIG. 1A); such as cold rolled steel, hot rolled steel, stainless steel, brass, aluminum, polyethelene, polystyrene, polyvinyl chloride, nylon, various impregnated or laminated fibrous materials, various plasticized materials, other polymers or any other plastics, various types of wood, etc. In other embodiments, the forward edge 26 of the reinforcing portion 24 may be any length, for instance from 0.250 inch to 12 inches, and in any shape suitable for the job. Also the length of the side edges 40R, 40L can be any length, say 0.250 inch to 8 inches, and be in any shape that effectively supports the operative extensions 34R, 34L. Furthermore, the angles 44R, 44L of the side edges 40R, 40L to the forward edge 26 of the reinforcing portion 24 may be any angle that provides a significant line of support for the operative side extensions 34R, 34L (FIG. 1A), in order to effectively produce the desired results. The forward corners 42R, 42L of the reinforcing portion 24 are slightly rounded each having a radius of 0.010 inch to 0.025 inch. However, in other embodiments the forward corners 42R, 42L may have no radius or any size of radius such as a radius of 0.002 inch. to 6 inches, and be of any given shape in order to achieve the desired configuration of the corner being formed.

As shown in FIG. 1D, the reinforcing portion 24 has identical, generally opposed major faces 50A, 50B, and is of tapered cross section, which varies from a minimum thickness of 0.005 inch to 0.050 inch at a forward region 24A, to an enlarged maximum thickness of 0.010 inch to 0.150 inch at about the rearwardly extending segment 24B. Transversely, (in FIG. 1C) the reinforcing portion 24 is of consistent thickness from side to side, perpendicular to the center line 22. The tapered cross section of the reinforcing portion 24 compensates for the inconsistent width of the portion 24, which enables the portion 24 to flex as desired, mainly in the forward region 24A, when pressed against a work surface. In other embodiments, the,reinforcing portion 24 may be of consistent cross section and/or any suitable plurality of thicknesses.

Affixed to the rearwardly extending segment 24B of the reinforcing portion 24 are the two handle halves 28A, 28B. In other embodiments, the handle halves 28A, 28B may consist of any material that has sufficient stiffness, and/or may be of any construction, such as a one piece handle which slides over the rearwardly extending segment 24B of the reinforcing portion 24. Overlaying both identical opposed major faces 50A, 50B of the reinforcing portion 24 are the two identical, resilient, flexible sheets 30. 32, which are preferably adhesively bonded directly to the reinforcing portion 24 as a three layer laminate (as shown in FIG. 1E, side view). As shown in FIG. 1F (end view), the sheets 30, 32 have two triangular side extension portions 52R, 52L and 54R, 54L, respectively, which are bonded to each other as two layer laminates, creating the operative extension side wiper blades 34R, 34L (as best shown in FIG. 1A). As shown in FIG. 1E, The forward edge 26 and the rearwardly extending segment 24B of the reinforcing portion 24 are, more or less, the only areas not covered with the sheets 30, 32.

As shown in FIG. 1B, the flexible sheet 32 and the reinforcing portion 24 are out of view. Being that the flexible sheets 30, 32 are essentially of the same shape and size, only the one sheet 30 is described. The forward edge 26, the side edges 40R, 40L, and the forward corners 42R, 42L of the reinforcing portion 24 are illustrated by broken phantom lines. The flexible sheet 30 is of consistent cross section and has two straight side edges 56R, 56L, which are 1 to 3 inches in length; the side edges 56R, 56L and the forward edge 36 terminate at forward corners 58R, 58L forming obtuse angles 60R, 60L of 60 to 120 degrees; two straight aft side edges 62R, 62L and a rear edge 64 parallel to the forward edge 36. Triangular shaped side portions 52R, 52L of the sheet 30 extend sidewardly beyond the side working edges 40R, 40L (illustrated by broken phantom lines) of the reinforcing portion 24 (which is out of view). The forward working edge 36 of the sheet 30 extends slightly sidewardly beyond the forward corners 42R, 42L (illustrated by broken phantom lines) of the portion 24, from 0.050 inch to 0.150 inch. However,, in other embodiments, the forward edge 36 of the sheet 30 may extend sidewardly any distance beyond the forward corners 42R, 42L of the portion 24, such as 0.001 inch to 2 inches. Or conversely, the reinforcing portion 24 may extend sidewardy beyond the forward corners 58R, 58L of the sheet 30 any distance, say 0.001 inch to 2 inches.

Furthermore, the forward edge 26 of the reinforcing portion 24 may extend forwardly, beyond the corresponding forward edge 36 of the sheet 30, any distance, say 0.002 inch to 2 inches for instance. Or conversely, the sheet 30 may extend forwardly beyond the forward edge 26 of the portion 24 any distance, such as 0.002 inch to 2 inches. The side edges 56R, 56L of the sheet 30 may be any length, say 0.250 inch to 6 inches, and any shape suitable for the job. The angles 60R, 60L of the side edges 56R, 56L to the forward edge 36 of the sheet 30 may be any angle which is sufficient for the use of the device on corner surfaces which deviate considerably from being at right angles, i.e. any angle of two adjoining corner surfaces to be worked upon. Furthermore, the angle 60R may be different than angle 60L. For example, one side of the device to be used for 90 degree inside corners and the other side for 135 degree inside corners. The two forward corners 58R, 58L of the sheet 30 are slightly rounded each having a radius of 0.010 inch to 0.025 inch. However, in other embodiments, the corners 58R, 58L may have no radius, or any size radius, such as a radius of 0.002 inch to 6 inches, and may be of any given shape in order to achieve the desired configuration of the corner being formed.

The resilient sheets 30, 32, in the preferred embodiment tool 20, are of a pliable, flexible, and/or resilient material, such as neoprene sheet rubber, 30 to 90 durometer, 0.025 inch to 0.150 inch in thickness, and of consistent cross section, available from American Rubber & Supply Co. of Van Nuys, Calif. However, the sheets 30, 32 can consist of any other material that is sufficiently pliable, flexible, and/or resilient, such as natural rubber, synthetic rubber, silicone rubber, high carbon steel, spring steel, stainless steel, polystyrene, polyvinyl chloride, nylon, various impregnated or laminated fibrous materials, various plasticized materials, foam type materials, other polymers or any other plastics, etc., and may be of tapered cross section, or any other plurality of thicknesses sufficient for producing the desired results. The adhesive bonding the flexible sheets 30, 32 to each other and to the reinforcing portion 24 as a laminate, is a contact cement, e.g. Dap smooth spread contact cement available from American Rubber & Supply Co. of Van Nuys, Calif. However, the laminate interrelationship of the sheets 30, 32 to the reinforcing portion 24 and to each other can consist of any other material or means which affixes the sheets 30, 32 to the portion 24 and to each other, thereby, preventing peeling or otherwise separating, e.g., two part epoxy, other contact cements, silicone rubber adhesive, heat bonding, heat sensitive adhesive, pressure sensitive adhesive, double sided adhesive tape, clamping device, various fasteners, welding, soldering, etc.

Additional embodiments of the present invention are shown in FIGS. 2 to 7. For exemplary purposes, the embodiments of the adjoining surface device shown in FIGS. 2A to 2C, 3, and 4 are each in the form of a hand tool. Each tool has a thin, flat, reinforcing blade portion, generally of the same size and isosceles trapezoidal shape, and is of consistent cross section; each has a straight forward working edge, the longest of the edges; two straight side edges at acute angles to the forward edge; and a straight rear edge parallel to the forward edge. The angles of the side edges to the forward edges of the reinforcing portion are from 50 to 85 degrees, the same as 44R, 44L of the embodiment tool 20, and the flexible sheets are from 60 to 120 degrees, the same as the angles 60R, 60L of the embodiment tool 20, previously mentioned and shown in FIGS. 1B and 1C. Furthermore, the relationship of the forward corners of the reinforcing blade and the corresponding forward corners of the resilient sheets is generally the same as the forward corners 42R, 42L and 58R, 58L of the embodiment tool 20, previously discussed and illustrated in FIGS. 1B and 1C. In each case, the device is generally wider than the tool 20, making the device most useful for working with larger areas. All of the embodiments consist of one or more of the materials described in the embodiment tool 20, and/or any other suitable material(s).

A first additional embodiment of the adjoining surface device of the present invention is illustrated in FIG. 2A (isometric view), FIG. 2B (top plan view of reinforcing portion with handle), and FIG. 2C (side view). It will be observed that a hand tool is generally indicated by numeral 66. Referring first to FIG. 2A, the tool 66 has a reinforcing blade portion 68 (which is mostly out of view, but shown in FIG. 2B) having a forward working edge 70, two side edges 72R, 72L (which are mostly out of view, but shown in FIG. 2B), and a rear edge 74. The reinforcing portion 68 is laminated between two identical, flexible sheets 76, 78. Furthermore, side extensions of the sheets 76, 78 are laminated to each other to create two operative extension wiper blades 80R, 80L. The two sheets 76, 78 are of the same size and isosceles trapezoidal shape and of the same consistent cross section, each having an identical forward edge 82, 84. Being that the two sheets are identical, only the one most visible sheet 76 is described here, having two side edges 86R, 86L and a rear edge 88 parallel to the forward edge 82. The forward edges 82, 84 of the sheets 76, 78 are more or less coterminous with the corresponding forward edge 70 of the reinforcing portion 68. Affixed to the length of the rear edge 74 of the reinforcing portion 68 is a U shaped support 90 (as best shown in FIGS. 2B and 2C). The support 90 consists of a semirigid material such as steel or aluminum, having two forward edges 92A, 92B. The support 90 is of consistent cross section, say about 0.010 inch to 0.200 inch in thickness, which is formed into a U shape that is wrapped, crimped, and/or otherwise affixed along the rear edge 74 (best shown in FIGS. 2A and 2C) of the reinforcing portion 68. The support 90 provides additional structural integrity to the rear edge 74 of the portion 68, enabling the portion 68 to be of the desired flexibility, while being of substantial width. The rear edges 88, 94 of the flexible sheets 76, 78 butt up to the forward edges 92A, 92B of support 90. As best shown in FIG. 2A, the sheets 76,78 extend sidewardly beyond the side edges 72R and 72L (72L is out of view, but shown in FIG. 2B) of the reinforcing portion 68, respectively. The laminar interrelationship of the flexible sheets 76, 78 and the reinforcing portion 68 is essentially the same as the preferred embodiment tool 20, previously described and shown in FIGS. 1E and 1F. Also the operative extension wiper blades 80R, 80L are essentially the same as the operative extensions 34R, 34L of the tool 20 (shown in FIG. 1A), with the exception of not having aft side edges. Affixed to the support 90 is a handle 96 which extends generally rearwardly.

A second additional embodiment of the device of the present invention is illustrated in FIG. 3 (isometric view). It will be observed that a tool is generally indicated by numeral 98. As shown in FIG. 3 the tool 98 has a reinforcing blade portion 100 with a front face (which is out of view), an opposite back face 102, a forward edge 104, two side edges (out of view), and a rear edge 106. Slightly inward from each corner of the back face 102 of the reinforcing portion 100 is a stud type fastener 108, which is welded or otherwise affixed perpendicular to the face 102. Partially overlapping the back face 102 of the reinforcing portion 100, say about 0.500 inch to 1.5 inches, are two removable and replaceable operative extension flexible wiper blades 110R, 110L, having two holes (out of view) which correspond with the studs 108. The operative extensions 110R, 110L protrude sidwardly beyond the side terminations (out of view) of the reinforcing portion 100, respectively. The right and left extensions 110R, 110L are essentially the same, each of consistent cross section, from 0.025 inch to 0.150 inch in thickness having a forward edge 112R, 112L, a rear edge 114R, 114L parallel to the forward edge 112R, 112L, an outwardly facing side working edge 116R, 116L, and an inwardly facing side edge 118R, 118L. The forward edges 112R, 112L and the rear edges 114R, 144L are more or less coterminus with the corresponding forward edge 104 and the rear edge 106 of the reinforcing portion 100. The inwardly facing side edges 118R, 118L are more or less parallel to the corresponding side terminations (out of view) of the reinforcing portion 100. Clamping the operative extensions 110R, 110L to the back face 102 of the reinforcing portion 100 are two clamp plates 120R, 120L of consistent cross section with a hole (out of view) more or less centered at each end corresponding to the location of the studs 108. Each clamp plate 120R, 120L has a forward edge 122R, 122L, a rear edge (only one is in view) 124R, an inwardly facing side edge 126R, 126L, and an outwardly facing side edge 128R, 128L. The forward edges 122R, 122L and the rear edges (in view) 124R of both of the clamp plates 120R, 120L more or less terminate at the corresponding forward edge 104 and the rear edge 106 of the reinforcing portion 100. The outwardly facing side edges 128R, 128L of the clamps 120R, 120L are more or less coterminus with the corresponding side edges (which are out of view) of the reinforcing portion 100. The inwardly facing edges 126R, 126L are more or less coterminous with the corresponding inwardly facing side edges 118R, 118L of the operative extensions 110R, 110L. Engaged on each stud 108 is a removable nut type fastener 130. The clamp plates 120R, 120L and the nuts 130 securely affix the operative extensions 110R, 110L to the reinforcing portion 100. There may be more than two studs and corresponding holes per clamp plate and operative extension. Furthermore, one or more of the holes may be elongated from front to back. There may be a second nut on each stud, locked tight against the first nut. The first nut is finger tight against the clamp plate. The finger tight nut, together with the elongated holes, allows the clamp plates to slide, enabling the reinforcing portion and the clamp plates to be flexed. At about the center of the back face 102 of the reinforcing portion 100 is a handle 132, affixed such as in the conventional manner of a cement or plastering trowel, which adds structural integrity to the portion 100.

A third additional embodiment of the device of the present invention is illustrated in FIG. 4 (isometric view). It will be observed that a tool is generally indicated by numeral 134. The tool 134 is shown having a reinforcing blade portion 136 with a front face (which is out of view), an opposite back face 138, a forward working edge 140, two side working edges 142R, 142L, and a rear edge 144. Completely overlaying the front face (which is out of view) of the reinforcing portion 136 is a flexible sheet 146 of consistent cross section, say about 0.100 inch to 0.750 inch in thickness, which may or may not be thicker than other embodiments. The sheet 146 has a forward working edge 148, two side working edges 150R, 150L, and a rear edge 152 parallel to the forward edge 148. The sheet 146 is adhesively bonded or otherwise affixed, as previously described (tool 20), to the reinforcing portion 136. As described above, the side working edges 150R, 150L of sheet 146 are at obtuse angles to the forward edge 148. Therefore, the sheet 146 has an isosceles trapezoidal shape, in the reverse manner of the reinforcing portion 136, thereby, creating two protruding operative extension wiper blades 154R, 154L, respectively. The forward edge 148 and the rear edge 152 of the sheet 146 are parallel to and extend beyond the corresponding edges 140, 144 of the reinforcing portion 136, a suitable distance for the job, such as 0.100 inch to 1 inch. The forward edge 148 is proportionally longer, say 0.200 inch to 2 inches, than the corresponding forward edge 140 of the reinforcing portion 136. At about the center of the back face 138 of the reinforcing portion 136 is a handle 156, affixed such as in the conventional manner of a cement, plastering, or grouting float, which adds structural integrity to the portion 136.

A fourth additional embodiment of the device of the present invention is illustrated in FIG. 5 (isometric exploded view). It will be observed that a tool is generally indicated by numeral 158. As shown in FIG. 5, the tool 158 consists of a reinforcing blade portion 160, which is similar to the reinforcing portion of tool 20, FIG. 1C (top plan view) and 1D (exploded side view), with the exception of being of increased tapered cross section. The reinforcing portion 160 has a forward edge 162, two generally opposed major faces (only one is in view) 164, two side faces (only one is in view) 166R, and a handle 168 is affixed. The portion 160 varies from a minimum thickness, of say 0.005 inch to 0.250 inch, at about the forward edge 162 to an enlarged maximum thickness, of say 0.015 inch to 0.500 inch, at about the handle 168. Affixed to the side faces (only one is in view)

166R of the reinforcing portion 160 are two protruding, operative extension wiper blades 170R, 170L. The operative side extensions 170R, 170L are more or less the same shape as the wiper blades of tool 20 FIG.1A (isometric view), however, they are of the same corresponding cross section as the reinforcing portion 160. The operative extensions 170R, 170L each have two generally opposed major faces (only one of each is in view) 172R, 172L and an inwardly facing side face (only one is in view) 174L. The side faces 174L (right face is out of view) of the operative extensions 170R, 170L butt against and are affixed to the corresponding side faces, 166R (Left face is out of view), of the reinforcing portion 160. The opposed major faces 164 (in view) of the reinforcing portion 160 are more or less in the same plane, and flush with the corresponding opposed major faces 172R, 172L (in view) of the operative extensions 170R, 170L. The interrelationship of the reinforcing portion 160 side termination and the operative extensions 170R, 170L may be any suitable means of affixing them to each other. For example, interlocking tongue and groove type connections for replaceable operative extensions, which may also be permanently affixed. The reinforcing blade portion 160 and the operative extension blades 170R, 170L may be molded by injection or otherwise formed, then affixed to each other by means of adhesive, ultrasonic welding, heat welding, etc. The handle 168, for example, may either be a separate part molded to the reinforcing portion 160, or may be molded as part of the portion 160 of the same material, as one unit.

A fifth additional embodiment of the device of the present invention is illustrated in FIG. 6A (isometric view) and FIG. 6B (side view). It will be observed that a tool molded by injection, or otherwise formed, is generally indicated by numeral 176. As shown in FIG. 6A, the tool 176 consists of a plastic or other moldable material formed into one piece or unit, having a reinforcing center portion 178, a forward edge 180, two flexible operative extension side wiper blade portions 182R, 182L, and a rearwardly extending handle portion 184. The operative extension portions 182R, 182L protrude beyond the side terminations of the reinforcing portion 178. The operative extensions 182R, 182L are more or less the same shape as the side operative extensions of tool 20 FIG.1A (isometric view), with the exception of being of tapered cross section. The reinforcing portion 178 is more or less the same shape as the reinforcing portion of tool 20 FIG. 1C (top plan view), with the exception of being of increased tapered cross section. The reinforcing portion 178 supports the side operative extensions 182R, 182L, and thus are interrelated in such a way as to provide a significant line of support, more or less along the side terminations of the thicker reinforcing portion 178. As shown in FIGS. 6A and 6B, the reinforcing portion 178 is tapered from a minimum thickness, of about 0.005 inch to 0.250 inch, at about the forward edge 180 to an enlarged maximum thickness, of about 0.015 inch to 0.500 inch, at about the handle portion 184. The operative extensions 182R, 182L are tapered from a minimum thickness, of about 0.002 inch to 0.100 inch., at about the forward edge 180 to an enlarged maximum thickness, of about 0.020 inch to 0.300 inch, at about rear corners 186R, 186L of the extensions 182R, 182L. The cross sections of the reinforcing portion 178 and the operative extension portions 182R, 182L may be any plurality of thicknesses and be in any configuration in order to provide the stiffness, flexibility and/or spring action to produce the desired results. The reinforcing portion 178 is much thicker and stiffer than the operative extensions 182R, 182L, which are thin for flexibility. The reinforcing portion 178 and the operative extensions 182R, 182L both vary in thickness for controlled overall flexure of the tool 176. The operative extensions 182R, 182L are flush, and more or less in one plane, with one of the major faces of the reinforcing portion 178 forming a single planar major face 188.

A sixth additional embodiment of the device of the present invention is illustrated in FIG. 7 (perspective operational view). It will be observed that an inside corner bead forming tool, for caulking or the like, is generally indicated by numeral 190. As shown in FIG. 7, the tool 190 consists of a reinforcing center portion 192, a forward edge 194, two side terminations 196R, 196L of the reinforcing portion 192, two flexible operative extension side wiper blade portions 198R, 198L protruding beyond the side terminations 196R, 196L, two side working edges 200R, 200L of the operative extension portions 198R, 198L, and a rearwardly extending handle portion 202. The tool 190 is more or less the same as tool 20, with the exception of the angles of the side terminations 196R, 196L of the reinforcing portion 192 to the forward edge 194 having angles of 85 to 130 degrees, and the side edges 200R, 200L of the operative extensions 198R, 198L to the forward edge 194 having angles of 95 to 165 degrees. Therefore, the side edges 200R, 200L are at angles of 10 to 150 degrees to each other. Furthermore the forward edge 194 is substantially shorter than the forward edge of tool 20, say from 0.100 inch to 1 inch in length. The forward edge 194 is not necessarily straight, e.g. may have any size radius or other shape in order to form the viscous material into a bead or other desired configuration.

Variant embodiments of the present invention are shown in FIGS. 8, 9, 10A and 10B. For exemplary purposes, in each case, the adjoining surface device is essentially the same as the first embodiment tool 20, previously discussed and illustrated in FIGS. 1A to 1F, with the exception of the variants hereafter disclosed. In each case, the tool is illustrated with one of the two identical flexible sheets mostly out of view, therefore, only the most visible sheet is described.

A first variant embodiment of the present invention is illustrated in FIG. 8 (isometric view). It will be observed that a tool is generally indicated by numeral 204. Referring to FIG. 8, the tool 204 consists of a reinforcing blade portion 206 (which is mostly out of view), a handle 208, one flexible sheet 210 most visible, and two side operative extension blades 212R, 212L. The reinforcing portion 206 has an exposed forward edge 214. The most visible flexible sheet 210 has a forward edge 216, a tapered section 218, and a flat nontapered section 220. The operative extensions 212R, 212L each have an outwardly facing side corner 222R, 222L. The tapered section 218 is from a minimum thickness, of about 0.002 inch to 0.100 inch, at about the forward edge 216 to an enlarged maximum thickness at about the side corners 222R, 222L consistently across the full width of the sheet 210, in one plane. The area of the tapered portion 218 in conjunction with the area of the nontapered section 220, which form the operative extensions 212R, 212L, helps balance the width to thickness ratio of the extensions 212R, 212L, aiding in more uniform flexibility, thereby, balancing the contact pressure between the working side edges of the operative extension blades 212R, 212L and the adjoining surface. Furthermore, the forward edge 214 of the reinforcing portion 206 is exposed, providing a more durable and stiffer forward working edge.

A second variant embodiment of the present invention is illustrated in FIG. 9 (isometric view). It will be observed that a hand tool is generally indicated by numeral 224. Referring to FIG. 9, the tool 224 consists of a reinforcing blade portion 226 (which is mostly out of view), a handle 228, one flexible sheet 230 most visible, and two side operative extension blades 232R, 232L. The side operative extensions 232R, 232L each have a side edge 234R, 234L, an aft side edge 236R, 236L and a rounded corner edge 238R, 238L therebetween. When the side edges 234R, 234L and the radiused peripheral corner edges 238R, 238L are urged against the adjoining surface not to be coated, a curved point of contact is produced. The curved point of contact tends to draw the viscous material from the side corners 238R, 238L toward the forward edge 240, where the material is formed into the applied surface. The rounded corners 238R, 238L each have a radius from 0.250 inch to 2 inches. However the corners 238R, 238L may have any size radius and be of any shape in order to effectively produce the desired results.

A third variant embodiment of the present invention is illustrated in FIGS. 10A (isometric view) and 10B (partial end view). It will be observed that a hand tool is generally indicated by numeral 242. Referring to FIG. 10A, the tool 242 consists of a reinforcing blade portion 244 (which is mostly out of view), a handle 246, one flexible sheet 248 most visible, and two side operative extension blades 250R, 250L. The operative extensions 250R, 250L each have identical lips 252A, 252B and 254A, 254B which are rounded, in cross section, extending along the full length of the corresponding side edges of the extensions 250R, 250L. As best shown in FIG. 10B, the rounded lip 252A has a radius from 0.010 inch to 0.100 inch, which protrudes beyond the plane of the corresponding major face 256R of the operative extension 250R. The rounded lips 252A, 252B and 254A, 254B, when urged against an adjoining surface not to be coated, produce a smaller and more consistent seal at the point contact, while the operative extensions 250R, 250L are in use and being flexed to various degrees. In addition, the smaller point of contact requires less force to produce a sealtight connection with the adjoining surface. The lips 252R, 252L may have any size radius and may be in any shape in order to effectively produce the desired results.

There are various possibilities with regard to the relative disposition of the resilient, and/or flexible sheets and the reinforcing blade portion which are laminated, fastened, bonded, fitted, or otherwise interrelated. For example, as illustrated in FIGS. 11 to 13 (which present end views), FIG. 11 shows a device 258 with a flexible sheet 260 laminated to one face of a reinforcing blade portion 262, having two flexible sheet segments 264R, 264L partially overlapping the opposite face of the reinforcing portion 262. FIG. 12 shows a device 266 with four flexible sheet segments 268R, 268L and 270R, 270L, which partially overlap both faces of a reinforcing blade portion 272, and FIG. 13 shows a device 274 with one flexible sheet 276 between two reinforcing blade portions 278A, 278B.

As discussed in the above description of the present invention, there are various possibilities with regard to the size, shape, and relative disposition of the reinforcing portion, flexible operative extensions, and the significant lines of support provided by the side terminations of the reinforcing portion for the operative extensions. For example, as illustrated in FIGS. 14 to 17, FIG. 14 (isometric exploded view) shows a device in the form of a hand tool that is generally indicated by numeral 280. Tool 280 is similar to tool 158 FIG. 5 (isometric exploded view) with the exceptions of having a reinforcing portion 282 of consistent cross section with indented side terminations 284R, 284L, two flexible operative extensions 286R, 286L shaped to effectively interconnect with the corresponding supporting side terminations 284R, 284L, and a removable handle 288.

The reinforcing portion 282 has a straight forward edge 290 terminating at two forward corners 292R, 292L, which protrude sidewardly beyond the corresponding indented side terminations 284R, 284L. The flexible extensions 286R, 286L are more or less of the same corresponding cross section as the reinforcing portion 282. The configuration of the extensions 286R, 286L is the same generally triangular, somewhat wedge shaped, as discussed in the above description. Each extension 286R, 286L has an outwardly facing straight side edge 294R, 294L, terminating slightly rearward from the forward edge 290 of the portion 282, more or less at the corresponding protruding forward corners 292R, 292L. The forward corners 292R, 292L of the portion 282 provide pivot points for the forward edge 290 of the portion 282 and the corresponding side edges 294R, 294L of the extensions 286R, 286L. For example, when the working side edge 294R of the right flexible extension 286R and the corresponding right forward corner 292R of the reinforcing portion 282 are urged against an adjoining surface, the forward working edge 290 of the portion 282 is able to pivot at the forward corner 292R in relation to the adjoining surface. Simultaneously, the side edge 294R of the extension 286R automatically pivots at the same corresponding forward corner 292R of the portion 282, in relation to the adjoining surface and also in relation to the forward edge 290 of the portion 282. The forward corners 292R, 292L are illustrated being somewhat square but, as discussed in the description, the corners may be any desired size and shape, such as being rounded for forming viscous material into a rounded inside corner configuration. The shape of the extensions 286R, 286L and corresponding indented side terminations 284R, 284L may be any other desired configuration, such as somewhat rectangular shaped extensions. The cross section of the reinforcing portion and operative extension may be any thickness or plurality of thicknesses suitable for the job.

The removable handle 288 has a forward edge 296 perpendicular to the gripping portion, with a longitudinal slot 298 lying parallel to and along the length of the forward edge 296 within the thickness of the handle 288. Two screw type fasteners 300 are inserted into holes (which are out of view) perpendicular to the walls of the slot 298 to form posts (out of view), spaced apart within the slot 298. The reinforcing portion 282 has a rear edge 302 parallel to its forward edge 290. The rear edge 302 has two slotted openings 304 located to accommodate the corresponding screw fasteners 300, when the rear edge 302 of the portion 282 is inserted into the slot 298 in the handle 288. The size and shape of the slot 298 is defined by the configuration of the rear edge 302 and associated region of the portion 282. The slotted openings 304 in the reinforcing portion 282 are configured so as to be able to snap onto the corresponding fasteners 300 in the handle 288. The fasteners 300 in the handle 288 are then tightened, effectively clamping the reinforcing portion 282. However, affixing the handle and the reinforcing portion to each other may be by any suitable means of affixture, such as: one or more releaseable snap or locking means; snap-engagement means; one or more locking posts or other structures in the slot within the handle that, when depressed or twisted, have a smaller diameter or other dimension in the region of contact with the reinforcing portion, which releases the reinforcing portion; a longitudinal interlocking bead and associated slot or dove tail type connect, in parallel to the forward edge of the reinforcing portion, that may be disconnected by sliding the handle and reinforcing portion apart sidewardly, which may include a locking or snap-engagement means, etc. The reinforcing portion and operative extension assembly is interchangeable with many other useful configurations, such as a semirigid blade portion with a straight forward working edge and without flexible operative extensions; a blade having a notched forward edge and without flexible extensions; various sizes and shapes of the above and other configurations; etc.

The flexible extensions 286R, 286L consist of neoprene rubber and the reinforcing portion 282 consists of a polycarbonate or a high impact polystyrene. The extensions 286R, 286L and the reinforcing portion 282 are affixed to each other with cyanoacrylate type adhesive, in more or less the same manner as described in the description of tool 158 FIG. 5. The reinforcing portion 282 and the flexible extensions 286R, 286L may consist of any one or more suitable materials and may utilize any other means of affixing or interrelating them to each other, as discussed in the above description. For example, the reinforcing portion may be molded, while simultaneously being welded or fused to preformed flexible extensions or vise versa. The material being molded to the first formed material may be heated to a molten fluid consistency at an adequate temperature to be molded and partially melt the associated first formed material. When the two materials cool, a durable welded or fused connection of the two materials is effected. There are many materials suitable for this forming and welding or fusing process such as a reinforcing portion consisting of a polypropylene and flexible extensions consisting of a dynamically vulcanized blend of polypropylene and EPDM rubber e.g. hercuprene thermoplastic elastomer, available from J-Von, Incorporated of Leominster, Mass. Many other materials are suitable for this manufacturing process, such as: various plastic alloys; plastic rubber alloys; polycarbonate alloys; other alloyed materials; block copolymers; random copolymers; and other copolymers; homopolymers; other plastics; thermoplastic elastomers; other elastomers; dynamically vulcanized blends of polycarbonate, other various polymers, plastics, or other materials with various types of rubber, thermoplastic elastomers, or other materials; etc. Further examples of a means of interrelating the reinforcing portion and the operative extensions are molecular hybridized transmutation of two or more materials or elements, molecular cohesion, molecular bonding or fusion, etc.

The forward working edge of the reinforcing portion may be any size and shape, as discussed in the above description, and the reinforcing portion is replaceable with various other configurations. For example, as illustrated in FIG. 15 (isometric view). FIG. 15 shows a reinforcing portion and operative extension assembly 306 that is similar to the reinforcing portion and operative extensions of tool 280 FIG. 14, with the exception of having a straight forward working edge 308 provided with a plurality of notches 310 regularly spaced along its length. This type of forward edge configuration is commonly used for spreading thinset tile adhesives, plaster, or other viscous materials. When the assembly 306 is used to spread a viscous material, strips of the material can pass between adjacent teeth 312, defined by the adjacent notches, 310 acting in effect as metering recesses to control the amount of material being spread onto the work surface by organizing the material into strips of predeterimined cross-sectional size and shape. The notches and adjacent teeth may be any desired shape and size suitable for the job.

The handle and reinforcing portion may be permanently affixed to each other, formed as one unit, etc., as discussed in the above description. For example, as illustrated in FIG. 16 (isometric view). FIG. 16 shows a tool 314 that is similar to tool 280 FIG. 14, with the exception of having a sheet like reinforcing portion 316 and handle portion 318 formed as one unit which is of consistent cross section, and an additional sheet like handle portion 320 laminated to the handle portion 318. The additional handle portion 320 is generally the same shape as the removable handle of tool 280 FIG. 14. The side and rear edges of the additional handle portion 320 are more or less coterminus with the corresponding edges of the handle portion 318. Affixed to the reinforcing portion 316 are two operative extensions 322R, 322L, which are essentially the same as the operative extensions of tool 280 FIG. 14. The means of interrelating the extensions 322R, 322L with the reinforcing portion 316 is generally the same as the means of interrelating the operative extensions with the reinforcing portion of tool 280 FIG. 14. Tool 314 may be constructed of consistent cross section without the additional handle portion 320, or with an additional handle portion laminated to each of the two major faces of the handle portion 318.

The present invention may include and/or be interrelated with any and variations of the features, elements, and configurations disclosed herein. For example, as illustrated in FIG. 17 (isometric partially exploded view). FIG. 17 shows a tool 324 having a reinforcing portion 326 with a handle 328 affixed, four fasteners 330 affixed to the portion 326, two removable semirigid support plates 332R, 332L configured to interconnect with the corresponding fasteners 330, and two flexible operative extensions 334R, 334L affixed to the corresponding support plates 332R, 332L.

The reinforcing portion 326 and handle 328 are similar to the reinforcing portion and handle of tool 20 FIG. 1C (top plan view of reinforcing portion with handle), and FIG. 1D (exploded side view) with the exception of the four fasteners 330. The reinforcing portion 326 has a major face 336 (the one face in view), a forward edge 338, two forward corners 340R, 340L, and two side edges 342R, 342L. The left side edge 342L is out of view, therefore, is illustrated in broken phantom lines. The fasteners 330 consist of a somewhat rigid material, each having a somewhat cylindrical shaft configuration with an enlarged flat head disposed at one end. The end of the shaft, opposite the head of each fastener 330, is welded or otherwise affixed to the major face 336 of the reinforcing portion 326, with the length of the shaft generally perpendicular to the face 336. One fastener 330 is located slightly inward from each of the two forward corners 340R, 340L, and one spaced apart from each forward corner 340R, 340L and slightly inward from each of the two corresponding side edges 342R, 342L, respectively.

The two removable support plates 332R, 332L are similar to the reinforcing portion of tool 280 FIG. 14 with respect to the cross section, the side terminations, the protruding forward corners, the parts of the forward edge closely associated with each of the corresponding forward corners, and the material of which they consist. Each support plate 332R, 332L has an inwardly facing edge 344R, 344L generally opposite an indented side termination 346R, 346L and extending from a forward edge 348R, 348L to a rear edge 350R, 350L. Along the inwardly facing edge 344R, 344L of each plate 332R, 332L are two slotted openings 352 located and configured to snap onto the corresponding shafts of the fasteners 330, and fit between the head of the fasteners 330 and the major face 336 of the reinforcing portion 326, as a snap-engagement means. The forward edges 348R, 348L of the plates 332R, 332L are more or less in line with the corresponding forward edge 338 of the reinforcing portion 326, and extend sidewardly beyond the associated side edges 342R, 342L of the portion 326. The side terminations 346R, 346L of the plates 332R, 332L extend slightly beyond the corresponding side edges 342R, 342L of the portion 326.

The plates 332R, 332L each have a recessed area to accommodate the associated thickness and shape of the reinforcing portion 326, making the extension area of the plates 332R, 332L essentially flush with the major face (out of view) of the portion 326 that is opposite the fasteners 330. The rear slotted opening 352 in each plate 332R, 332L is slightly elongated from front to rear, enabling the rear of the plates 332R, 332L to slide somewhat independently from the rear fasteners 330 when the reinforcing portion 326 is being flexed. There may be more than two fasteners and associated slotted openings per support plate. The fasteners and associated slotted openings may be any effective means of affixture, such as other snap-engagement means, screw or bolt type fasteners and corresponding holes in the plates, etc.

The two operative extensions 334R, 334L are essentially the same as the operative extensions of tool 280 FIG. 14, The means of interrelating the extensions 334R, 334L with the corresponding side terminations 346R, 346L of the removable support plates 332R, 332L is generally the same as the means of interrelating the operative extensions with the reinforcing portion of tool 280 FIG. 14.

From the descriptions above, a number of advantages of my adjoining surface devices become evident:

(a) A device with increased width, thereby, allowing a craftsman to apply and finish material on a larger surface, in less time.

(b) A device with operative extension blades which are easily replaceable and interchangeable with various blades, thereby, easily adaptable to various angles, shapes, and textures of the adjoining surface.

(c) A hand tool which can be used in a manner similar to that of using a cement or plaster finishing trowel, which has the prior art advantage of the handle mounted on the major face of the reinforcing blade portion, and the novel features of the operative extension portions.

(d) A device having a reinforcing portion and at least one operative extension which are a plurality of thicknesses, in cross section, configured to provide optimal stiffness and flexibilities for controlled overall flexure and spring action of the device. Furthermore, the performance of the device is optimized by the plurality of thicknesses employed, which provide the most favorable size and shape of the working edges, and contact pressures of the edges against the adjoining surfaces and against the viscous material. The device is configured according to all the work parameters and conditions, providing optimum performance. The device is completely one piece or unit, whereby, the device is additionally simple and inexpensive to manufacture by means of injection molding or other type of forming.

(e) The tapered portion of the sheets, which extends beyond the corresponding termination of the reinforcing portion, in conjunction with the nontapered portion of the operative extension blades, helps balance the width to thickness ratio of the operative extensions, aiding in more uniform flexibility, thereby, balancing the contact pressure between the working side edge of the operative extensions and the adjoining surface. The more uniform contact pressure decreases the amount of sideways pressure that is necessary for the craftsman to apply in order to achieve a consistent sealtight connection between the side edges and the adjoining surface. Furthermore, the forward edge of the reinforcing blade portion may be exposed to provide a stiffer and durable forward working edge.

(f) The rounded corner of the operative extension blade produces a curved line of contact with the adjoining surface. The outer portion of the line of contact is at a lesser angle to the work surface than with straight side edges. The lesser angle tends to draw the viscous material from the side corner toward the forward edge of the device, where the material is being formed into the applied surface.

(g) A device with lips, along the side edges of the operative extension blade, that produces a narrower and more consistent line of contact with the adjoining surface while the extension blade is in use and being flexed in various areas. The consistent narrow line of contact requires only a minimum amount of force, applied to the device by the craftsman, to produce a consistent viscous-tight seal with the adjoining surface.

(h) A device having a continuous plane of the surfaces of one or both major faces of the reinforcing portion and the flexible operative extensions, in order to facilitate wiping the device clean of material.

(i) A device which requires less resilient or flexible sheet material for manufacturing, thereby, reducing the cost of manufacturing and materials.

(j) A device of laminate construction which requires less of the flexible sheet material for manufacturing, aids in the adhesion of the flexible sheet to the reinforcing blade portion, and is less prone to peeling apart at the lamination, thereby, providing a higher quality and longer lasting tool or device.

(k) A device having a semirigid forward working edge and flexible sheet of consistent cross section. This is desirable to lower the cost, where tapering the flexible sheet material is not necessary to achieve flexibility to effectively produce the desired results.

Operation—FIGS. 7, 18 and 19

The manner of using the adjoining surface devices of the present invention to apply and finish viscous materials along an adjoining surfaces is similar, and in some situations identical, to that for some tools and other devices in present use, including some of those previously mentioned in the background section of this patent.

Tool 66 (FIGS. 2A to 2C), and tool 280 (FIG. 14), are used more or less in the same manner as tool 20 (FIGS. 1A to 1F). For example, tool 20 is shown in FIG. 18. In residential and commercial construction a sheet of drywall 354 (work surface) is installed, which more or less butts against an adjoining surface not to be coated 356, forming an inside corner. If there happens to be a gap 358 between the drywall edge and the adjoining surface 356, the gap 358 is bridged with a drywall joint tape 360. The edge of the tape 360 butts up to and conforms to the adjoining surface 356, thereby extending the plane of the drywall- work surface 354 to the adjoining surface 356.

The craftsman first applies a bed coat of joint compound 362 by drawing the tool 20 along the surfaces 354, 356 at the inside corner, in the direction indicated by arrow 364. The tool 20 is positioned with the working face (which is out of view) of the blade basically at an acute angle to the drywall work surface 280; with the joint compound sandwiched between the working face of the tool blade and the drywall work surface 354, with the forward working edge 38 more or less against or skimming over the work surface 354, and more or less at a right angle to the adjoining surface 356, and having the resilient side edge 56L urged against the adjoining surface 356 a sealtight connection is produced, while simultaneously forming the applied bed coat 362 along the adjoining surface 356.

The craftsman then lays the joint tape 360 in the bed coat 362 while it is still wet. While drawing the forward edge 38 of the tool 20 along the work surface 354 imbedding the joint tape 360, the air pockets and excess compound are squeezed out. The angle of the resilient side edge 56L to the forward edge 38 is variable and resilient. The variable angle automatically compensates for irregularities in the adjoining surface 356, inconsistencies in the angle of the corner, and any significant deviation of the angle of the corner from being more or less a right angle, thereby, preventing the joint compound from oozing onto the adjoining surface 356 and/or the applied bed coat 354, and tape 360. The tool 20 pivots at the forward corner 42L, while automatically maintaining the sealtight connection between the side edge 56L and the adjoining surface 356. Therefore, the tool 20 is not sensitive to the exact positioning in relation to the adjoining surface 356. The large area of contact of the resilient side edge 56L spans the irregularities in the adjoining guide surface 356 and absorbs the shock of the irregular adjoining guide surface 356, essentially eliminating blade chatter, which facilitates a smooth operation, thus, a smooth applied surface of the bed coat 362. The craftsman lets the bed coat 362 dry and then, in the manner described above, forms an additional coat of joint compound 366 into a smooth applied surface 368 over the reinforcing joint tape 360 and the bed coat 362. During the drying process, the compound shrinks as the water evaporates from the compound, thereby, effecting irregularities in the applied surface 368. Therefore, three to four applications of joint compound are usually required to achieve a smooth applied surface 368. The resilient side edge 56L and the forward working edge 38 work together simultaneously, to effect a clearly, defined, uniform, continuous junction 370 of the smooth applied surface 368 and the clean, unscathed adjoining surface 356.

Tool 98 (FIG. 3) is used in more or less the same manner as tool 134 (FIG. 4). For example, tool 134 is shown in FIG. 19. The manner of using the tool 134 is essentially the same as the description of the tool 20 FIG. 18, with the exception of the way in which it is grasped due to the location of the handle 156. For example, as shown in FIG. 19, the tool 134 is pulled along the adjoining surface 372, forming an applied surface 374 of viscous material being applied 376, and worked in the direction indicated by arrow 378. The side edge 150R of the operative extension is urged against the adjoining surface 372, while simultaneously the forward working edge 148 forms the applied surface 374. It is as easy to produce a clearly defined uniform junction 380 of the applied surface 374 and the adjoining surface 372 as in the use of tool 20, described above and shown in FIG. 18. It is usually desirable to have the handle 156 in the location illustrated in order to generate the force required to work with viscous materials of thicker consistency such as cement, plaster, tile grout, or other like materials.

The manner of using the tool 190 for finishing caulking, sealants, or other viscous materials along an inside corner is somewhat the same as the use of the tool 20, described above and shown in FIG. 18. For example, as shown in FIG. 7, during original construction and/or repair work, interior and exterior inside corners are frequently encountered where there is an undesirable crack or seam 382 between the two work surfaces 384A, 384B and/or irregularities at the corner. A bead of caulking 386 dispensed along the length of the corner by the use of a caulking gun or other means. Tool 190 is then placed directly into the corner of the two work surfaces 384A, 384B, usually with the forward working edge 194 more or less at a third adjoining surface, e.g. two wall surfaces and a ceiling surface. The tool 190 is positioned at an acute angle of, say 30 to 60 degrees, to the corner being worked upon, and centered between the two surfaces 384A, 384B with the forward edge 194 spanning the corner, as the tool 190 voluntarily finds the center of the corner. Therefore, the forward working edge 194 consistently spans the corner, while simultaneously both of the operative extension blades 198R, 198L are urged against the work surfaces 384A, 384B. A sealtight connection is then produced between the side working edges 200R, 200L of the extension blades 198R, 198L and the adjoining surfaces 384A, 384B. The tool 190 is then pulled along the corner in the direction of the acute placement angle which is also indicated by arrow 388. The dispensed bead of caulking 312 is then formed into a continuous uniform bead 390 along the corner by the forward working edge 194. The formed bead 390 conceals the crack or seam 382, and/or irregularities of the corner. In one pass, the tool 190 effectively produces clearly defined, continuous inside corners 392A, 392B of the smooth, uniform applied bead surface 390 and the adjoining surfaces 384A, 384B. The adjoining surfaces 384A, 384B and the formed bead surface 390 are substantially free of excess caulking, due to the continuous seal produced by the side working edges 200R, 200L of the operative extensions 198R 198R thereby, in one pass, a fine finished product is produced easily and efficiently.

Summary, Ramifications and Scope

All of the features disclosed and illustrated herein are examples of some of the configurations which are applicable to all of the adjoining surface devices of the present invention.

Accordingly, the reader will see that the adjoining surface device of this invention can be used easily and efficiently to effectively apply and/or finish viscous materials, along at least one adjoining surface to produce a uniform, clearly defined junction of the applied surface and the adjoining surface, while simultaneously effecting all of the surfaces substantially free of any excess of the material being applied. The angle of the side edges to the forward edge of the device is variable, the operative extensions are flexible, and the forward working edge is somewhat rigid. Therefore, the device provides a good forward edge for forming viscous materials, and operative extensions which, when urged against a surface, continuously produce a sealtight connection. The angle of the for ward edge to the side edges being variable and resilient, automatically conforms to irregularities in the angle of the corner and to the position in which the tool is being held, while a sidewardly force is maintained against the adjoining surface. The side edges, being flexible and relatively large conform to and span surface irregularities. Therefore, the constant sideways force continuously maintains the seal between the side edge and the adjoining surface. The seal prevents the viscous material from oozing between the side edge of the tool and the adjoining surface, and from being deposited on the surfaces. Furthermore, the large flexible side edges span and absorb the shock of surface irregularities as the device moves along the adjoining surface. Therefore, the device moves more smoothly than the prior art tools along the surfaces, and the forward edge produces a smooth surface easily. Furthermore, the flexible side edges do not scrape a groove in the adjoining surface, and do not deposit the particles into the material being applied. The variable position in which the tool can be held enables a craftsman to readily apply his skill with greater perfection while the viscous material is being formed into the applied surface, thereby, the desired results are produced easily and efficiently. The device can be used easily and efficiently to clean various containers. In addition, the product of clean smooth surfaces greatly reduces, if not eliminates, an entire second operation after each application of material to scrape, sand, and clean up any excess material.

Furthermore, the elimination of the second operation has additional advantages in that the surfaces will not be scratched or grooved;

no cavities will be created from protrusions being scraped off;

no dried material will be cracked or broken out of voids;

no dried particles will contaminate the material being applied, which cause chatter marks and grooves;

dust will not have to be removed from the surfaces to provide the clean surfaces necessary for good adherance of the next application of material;

there are considerably fewer voids and chatter marks to fill in following each application;

no additional time and labor is spent on the second operation; and the risk of carpal tunnel syndrome and other physical disorders related to prolonged repetitive motion and pressure is substantially reduced.

a handle that is offset from being at a right angle to a forward working edge and/or offset from being centered about the forward edge;

a reinforcing portion with only one operative extension; and

Although the description above contains many specificities, these should not be construed as limiting the scope of the invention, but as merely providing illustrations Of some of the presently preferred embodiments of this invention. For example, the adjoining surface device can be of other configurations, such as injection mold or other type of forming flexible material to one or both sides of a reinforcing portion and forming flexible operative extensions;

a reinforcing portion fitted into a molded flexible portion, having operative extensions, being an interference fit, and/or bonded;

molded flexible material of one or more operative extension portions, which partially overlap one or both major faces of a reinforcing portion;

operative extensions consisting of thin flexible sheet metal, which is welded or otherwise affixed to a reinforcing portion;

the reinforcing portions and the operative extensions may be of any suitable plurality of thicknesses, tapered cross sections, and/or consistent cross sections;

the handles may be any other means for applying a controlled directional force to the devices, in order to produce the desired results. For example, the means for applying a controlled directional force to the device may be a part of a machine, or apparatus, used for spreading viscous materials along an adjoining surface in the manufacture of materials, such as drywall sheets, cement blocks, cement curbs, moldable plastics, various lamination processes. As an example of one of the lamination processes, in the manufacturing process of laminate surfaces where a controlled layer or film of viscous material is spread along an adjoining surface, while simultaneously effecting an adjoining surface substantially free of excess material being applied and formed. The layer of material being formed butts against the adjoining surface, producing a clearly defined continuous junction of the surface being applied and the adjoining surface, easily and efficiently.

Any embodiment of the present invention may be configured so as to include any combination of the features disclosed herein.

Thus the scope of the invention should be determined by the appended claims and their legal equivalents, rather than by the examples given.

I claim:

1. A device for spreading a viscous material on a surface, comprising:

a substantially rigid and planar blade member having a substantially straight working edge at an end thereof, said blade member having at least one substantially straight side edge adjacent to and extending from said working edge and defining an oblique angle therebetween;

at least one substantially planar flexible side flap integrally formed with and along said at least one side edge of said blade member and comprised of a resilient material;

said at least one side flap is mounted to said blade member such that it is free to flex about an axis coincident with said at least one side edge, said at least one side flap having an increasing width along said side edge from adjacent said working edge to a portion spaced therefrom; and a handle mounted to a portion of said blade member;

whereby said at least one side flap readily conforms to said surface, thus removing any excess material thereon.

2. The device of claim 1 wherein said oblique angle defined by said at least one side edge and said working edge is an acute angle.

3. The device of claim 1 wherein said blade member having a thickness that tapers toward said working edge.

4. The device of claim 1 wherein said at least one side flap having an increased thickness spaced from said working edge.

5. The device of claim 1 wherein said at least one side flap having at least one peripheral lip protruding beyond at least one of it's major surfaces.

6. The device of claim 1 wherein said at least one side edge and said working edge terminate at a rounded corner of said blade member.

7. A device for working viscous materials along at least one surface comprising:

a blade member having two generally opposed major surfaces and a working edge at an end thereof, the blade member having two side peripheries and each side periphery is located respectively at generally opposite portions of the blade member adjacent to and extending from the working edge;

two resiliently flexible side flaps and each side flap having two generally opposed major surfaces, means integrally connecting one of the two side flaps with and along each side periphery of the blade member; and each of the two side flaps having a width projecting from and increasing along the side periphery from adjacent the working edge to a portion spaced therefrom, each side flap is mounted to the blade member such that it's increasing width is free to flex and bend increasingly inward from along it's outer periphery;

whereby at least one of the two side flaps readily conforms to the at least one surface, thus removing any excess material thereon.

* * * * *